US007891281B2

(12) United States Patent
Baldi et al.

(10) Patent No.: US 7,891,281 B2
(45) Date of Patent: Feb. 22, 2011

(54) HOUSING-TRANSPORTATION-LAUNCH ASSEMBLY AND METHOD

(75) Inventors: Bruno Baldi, Rome (IT); Roberto De Girolamo, Rome (IT); Teodoro Andrea Dragani, Rome (IT); Sandro Mazzuca, Rome (IT); Gian Fabrizio Venarucci, Rome (IT)

(73) Assignee: MBDA Italia S.p.A., Rome (IT)

( * ) Notice: Subject to any disclaimer, the term of this patent is extended or adjusted under 35 U.S.C. 154(b) by 686 days.

(21) Appl. No.: 11/400,017

(22) Filed: Apr. 7, 2006

(65) Prior Publication Data

US 2010/0236391 A1 Sep. 23, 2010

(30) Foreign Application Priority Data

Apr. 7, 2005 (IT) ..... RM2005A0166

(51) Int. Cl.
*F41F 3/042* (2006.01)

(52) U.S. Cl. ..... 89/1.815; 89/1.816

(58) Field of Classification Search ..... 89/1.8, 89/1.806, 1.815, 1.816, 1.817, 1.819, 1.82
See application file for complete search history.

(56) References Cited

U.S. PATENT DOCUMENTS

| | | | | |
|---|---|---|---|---|
| 3,106,132 | A * | 10/1963 | Biermann et al. | 89/1.815 |
| 3,742,813 | A | 7/1973 | Kongelbeck | |
| 3,769,876 | A | 11/1973 | Haas et al. | |
| 3,789,729 | A | 2/1974 | Aupy | |
| 3,983,785 | A | 10/1976 | Dissmeyer et al. | |
| 4,016,796 | A * | 4/1977 | Brannan | 89/1.806 |
| 4,184,408 | A * | 1/1980 | Smith et al. | 89/1.806 |
| 4,550,640 | A * | 11/1985 | Harter | 89/1.806 |
| 4,911,059 | A * | 3/1990 | Brueckner | 89/1.819 |
| 5,056,407 | A | 10/1991 | Mathey | |
| 5,115,711 | A | 5/1992 | Bushagour et al. | |
| 5,153,367 | A | 10/1992 | Markquart et al. | |
| 5,198,610 | A | 3/1993 | Kennedy et al. | |
| 5,714,708 | A * | 2/1998 | Shim et al. | 89/1.806 |
| 6,125,734 | A | 10/2000 | Yagla | |
| 2003/0230589 | A1 | 12/2003 | Wang et al. | |
| 2003/0231937 | A1 | 12/2003 | Wang | |
| 2005/0066800 | A1 * | 3/2005 | Hagan et al. | 89/1.806 |

FOREIGN PATENT DOCUMENTS

| | | |
|---|---|---|
| DE | 43 31 835 | 3/1995 |
| DE | 199 00 548 | 7/2000 |

OTHER PUBLICATIONS

English Abstract of DE 199 00 548 dated Jul. 13, 2000.
English Abstract of DE 43 31 835 dated Mar. 30, 1995.

* cited by examiner

*Primary Examiner*—Bret Hayes
(74) *Attorney, Agent, or Firm*—Ladas & Parry LLP

(57) ABSTRACT

In a ground launcher, two or more housing-transportation-launch assemblies for respective missiles are placed one on top of the other and connected releasably and interchangeably to each other; each housing-transportation-launch assembly has a respective outer casing, which in turn has longitudinal end walls breakable from inside the casing, and a deflecting body for deflecting the exhaust gas of the engine of the missile; a guide and protection assembly being interposed between the casing and the missile to guide the missile in the set launch direction, and to protect the missile against shock or vibration.

43 Claims, 29 Drawing Sheets

HOUSING-TRANSPORTATION-LAUNCH ASSEMBLY AND METHOD

The present invention relates to a missile housing-transportation-launch assembly, and to a ground launcher featuring such missile housing-transportation-launch assemblies.

BACKGROUND OF THE INVENTION

Areas subject to aircraft or missile attack are defended using stationary or self-propelled vertical ground launchers equipped with medium-range munition-configured missiles, to which the following description refers purely by way of example.

Known mobile ground launchers of the type described above are unsatisfactory in terms of ease of transport and mobility, as well as in terms of operating efficiency and dependability.

In particular, transportation of known launchers, especially by military aircraft (e.g. C-130s), involves dismantling the launcher, thus preventing immediate use on arrival.

Moreover, mobile launchers of the above type cannot be reloaded independently or quickly and easily, especially at the launch site. Even in the case of more evolved launchers employing munition-configured missiles, i.e. supplied complete with a launch container, the launcher or missile battery is normally provided with a reloading unit, which impairs mobility, ease of transport and immediate deployment, creates logistic problems, and increases cost.

The cause of the above drawbacks substantially lies in the considerable weight and size of known ground launchers.

Known launchers are described, for example, in U.S. Pat. No. 6,526,860, which describes a missile launching cell comprising an inner lining structure of composite material with surfaces designed to guide the missile during launching; and an outer casing with an end portion in the form of an integrated compensating chamber. Though cheap and lightweight, the launching cell can only be used once, and fails to safeguard the missile against accidental shock and vibration. In other words, the cell described performs no damping function, so that external forces are transferred directly to the missile.

American U.S. Pat. No. 6,755,111, on the other hand, describes a complex launcher, which differs from the object of the present invention by comprising a compensation chamber and missile rocket combustion gas exhaust conduits, and which has cavities for receiving missiles housed in launching cells.

American U.S. Pat. No. 6,584,881 describes a missile launch module that can be transported on military ground vehicles, and which, unlike the present invention, is connected in a fixed, normally vertical, position to the base structure.

American U.S. Pat. No. 6,584,882 describes a self-sufficient missile launching cell with exhaust conduits connected to the compensation chamber. The conduits guide the rocket combustion gases, deflected from the compensation chamber, to the front end of the launching tube, which also acts as a storage container.

U.S. Pat. No. 6,311,604, on the other hand, describes a breakthrough hatch, substantially designed to close the front end of a launching tube.

SUMMARY OF THE INVENTION

It is an object of the present invention to provide a housing-transportation-launch assembly for vertical-launch missiles, designed to provide a straightforward, low-cost solution to the aforementioned drawbacks, and which at the same time is highly efficient and dependable.

According to the present invention, there is provided a housing-transportation-launch assembly for a missile, the assembly comprising an outer casing housing said missile; the casing being made of metal and comprising a lateral wall, a front breakthrough wall, a jet deflector connected integrally to a rear portion of said lateral wall, and a rear breakthrough wall closing an outlet of said jet deflector and which is broken by the exhaust gases of said missile.

The jet deflector of the assembly defined above preferably comprises a deflecting surface for guiding an exhaust jet in an exhaust direction crosswise to a longitudinal axis of said casing, and directing the exhaust jet far away from said casing of the housing-transportation-launch assembly.

The present invention also relates to a ground launcher comprising such missile housing-transportation-launch assemblies.

According to the present invention, there is provided a ground launcher comprising a self-propelled structure; a supporting structure loaded with a number of housing-transportation-launch assemblies as claimed in the attached Claims, and fitted adjustably to said self-propelled structure; and actuating means for moving the supporting structure between a loading position and a launching position; said supporting structure comprising first locating and retaining means which engage second locating and retaining means on each of said housing-transportation-launch assemblies.

The present invention also relates to a method of producing a missile housing-transportation-launch assembly.

According to the present invention, there is provided a method of producing a casing, in particular for housing, transporting, and launching missiles; the method comprising the steps of forming a number of longitudinal lateral panels; and being characterized by also comprising the steps of forming at least one pair of first connecting members for connecting said lateral panels to one another, and at least one pair of second connecting members for connecting said lateral panels and differing constructionwise from said first connecting members; and stably connecting the lateral panels to one another by means of said first and second connecting members; connection of said lateral panels comprising the steps of forming at least two distinct portions, at least one of which comprises at least two lateral panels connected to each other by said first connecting members; and stably welding said portions to each other by means of said second connecting members.

BRIEF DESCRIPTION OF THE DRAWINGS

A non-limiting embodiment of the invention will be described by way of example with reference to the accompanying drawings, in which.

DETAILED DESCRIPTION OF THE INVENTION

Figure 1:
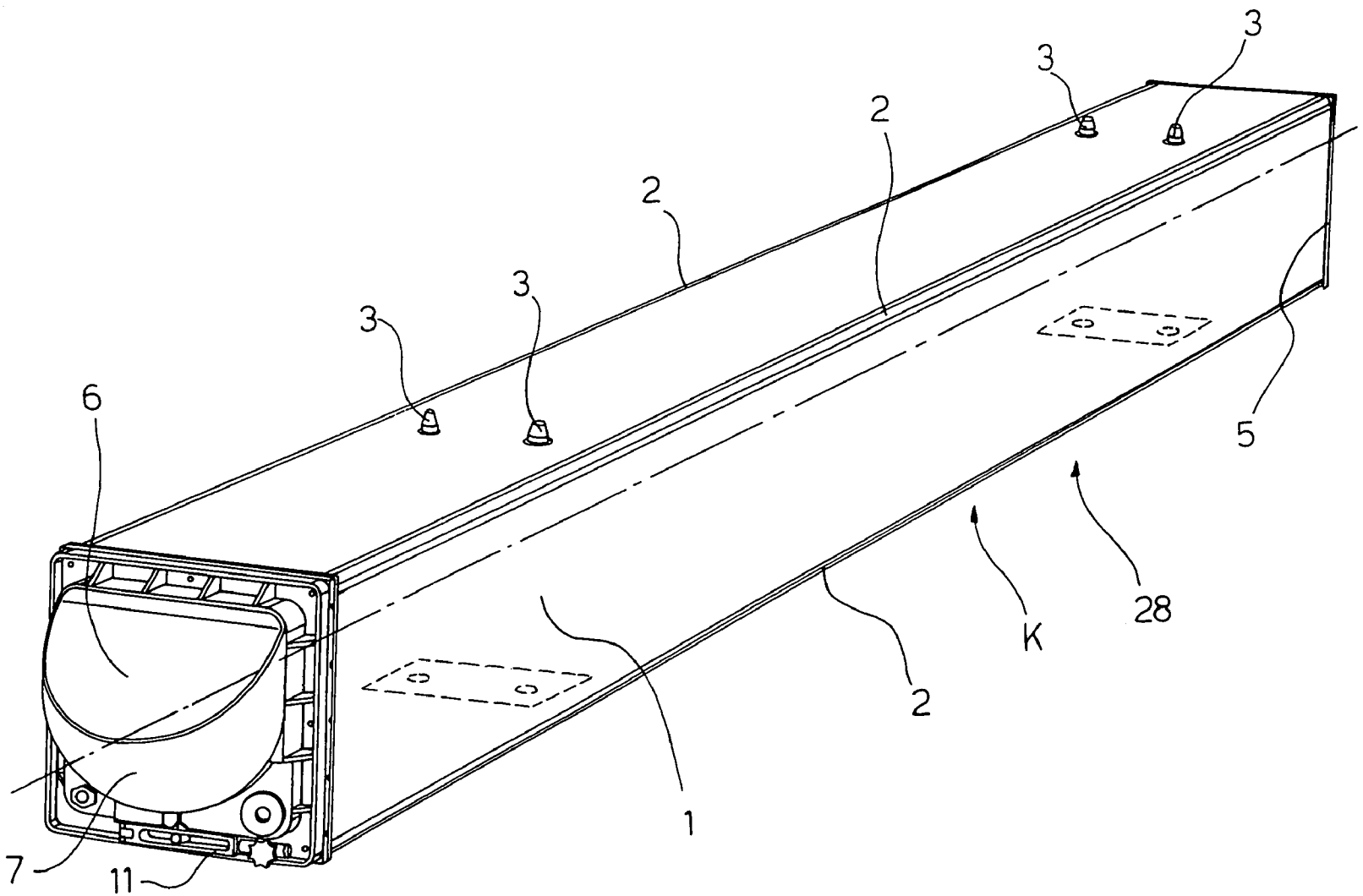
FIG. 1 shows a view in perspective of a preferred embodiment of the housing-transportation-launch assembly according to the present invention.

Number 28 in FIG. 1 indicates as a whole a modular housing-transportation-launch assembly for a munition-configured medium-range missile 21. Assembly 28 comprises a tubular outer casing K made of metal, conveniently aluminium, and which is parallelepiped-shaped with a square cross section, as shown in FIG. 1, or a hexagonal cross section, as shown in FIG. 2.

Figure 2:
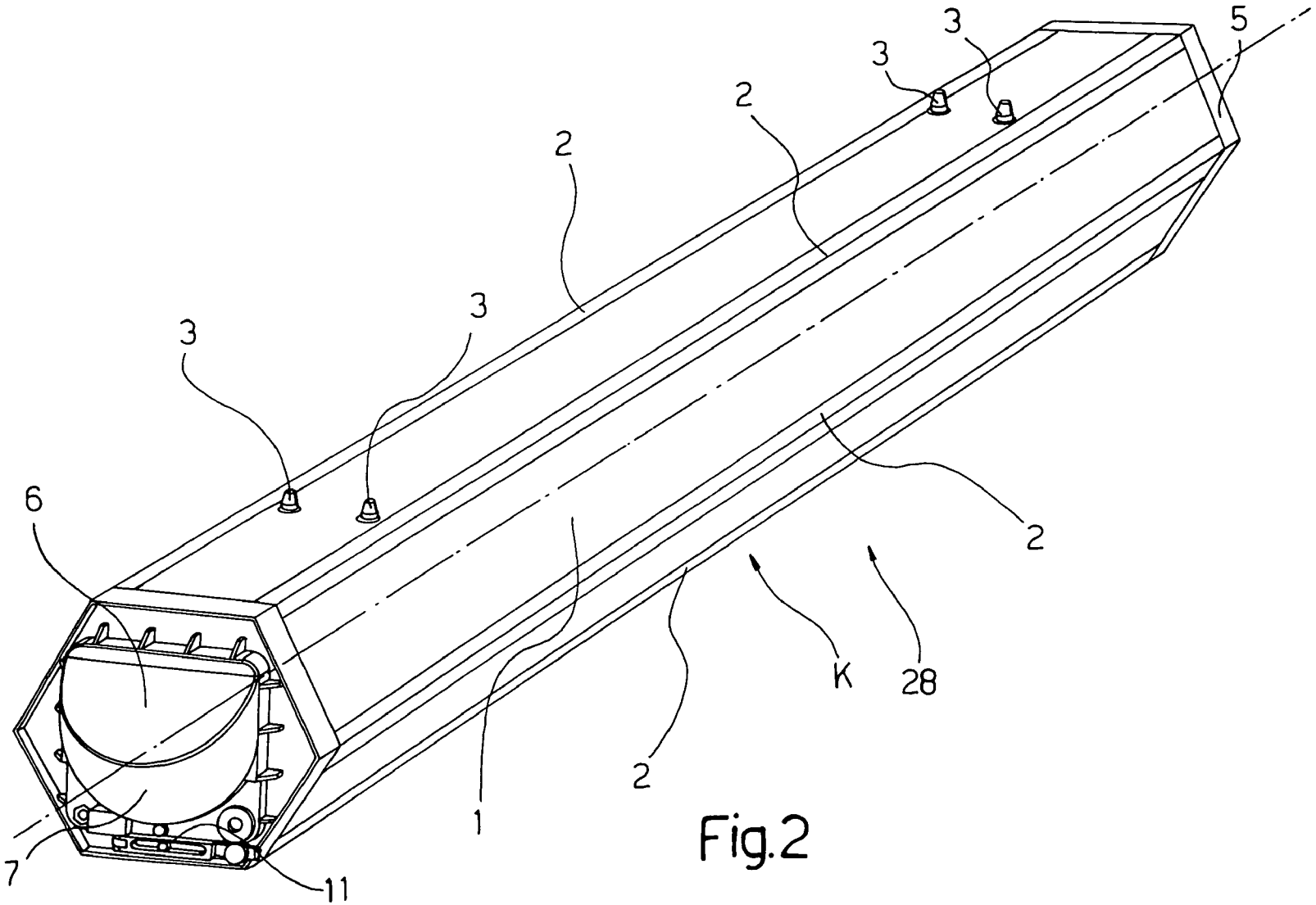
FIG. 2 is similar to FIG. 1, and shows a variation of a FIG. 1 detail.
Figure 11:
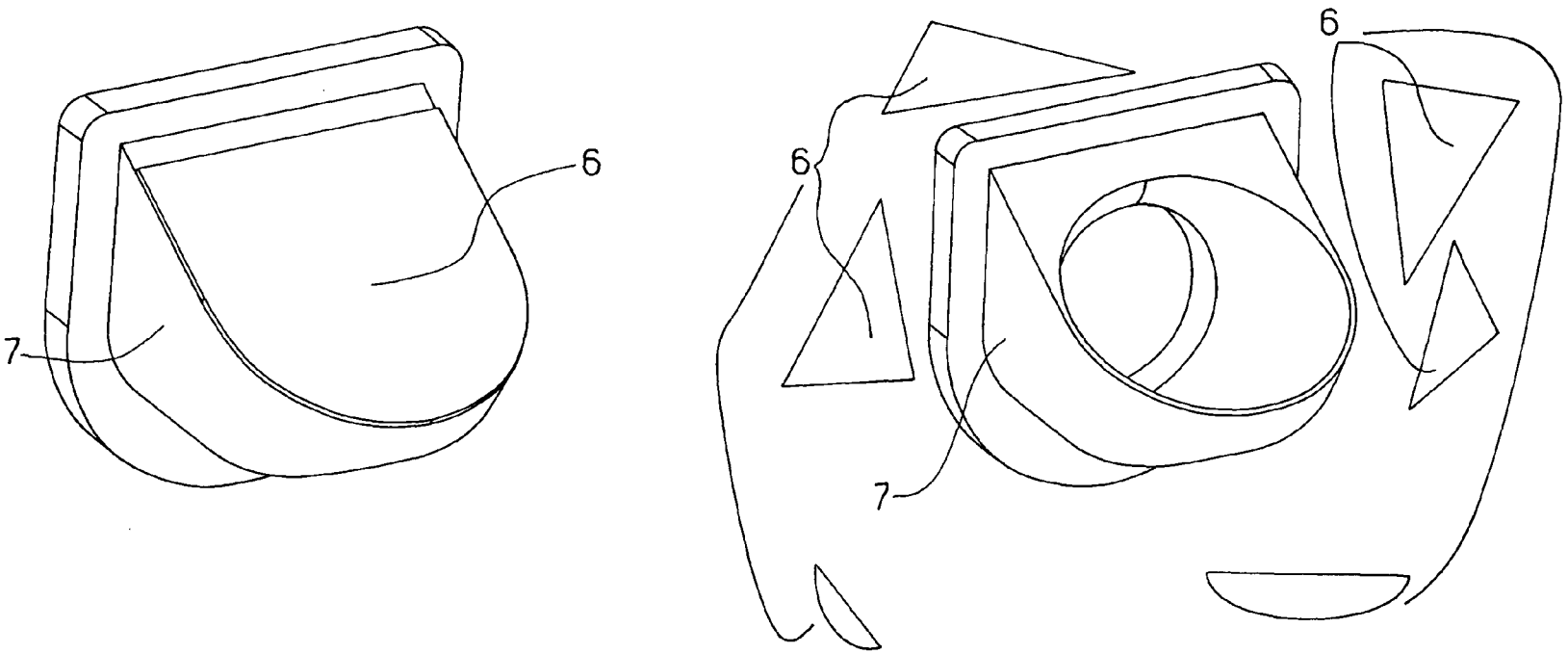
FIG. 11 shows a rear portion of the FIG. 1 assembly in two different operating conditions.
Figure 12:
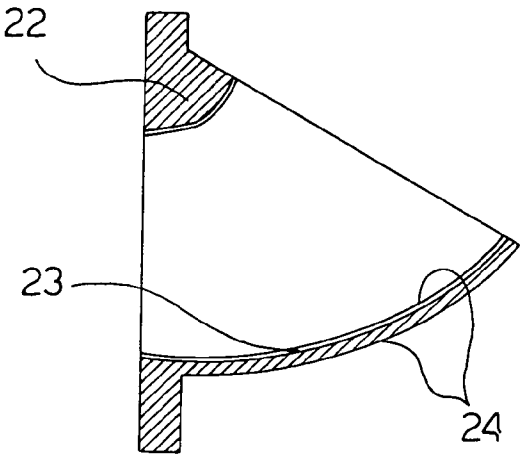
FIG. 12 shows a view in perspective and a section, with parts removed for clarity, of an end portion of the FIG. 1 assembly.
Figure 12:
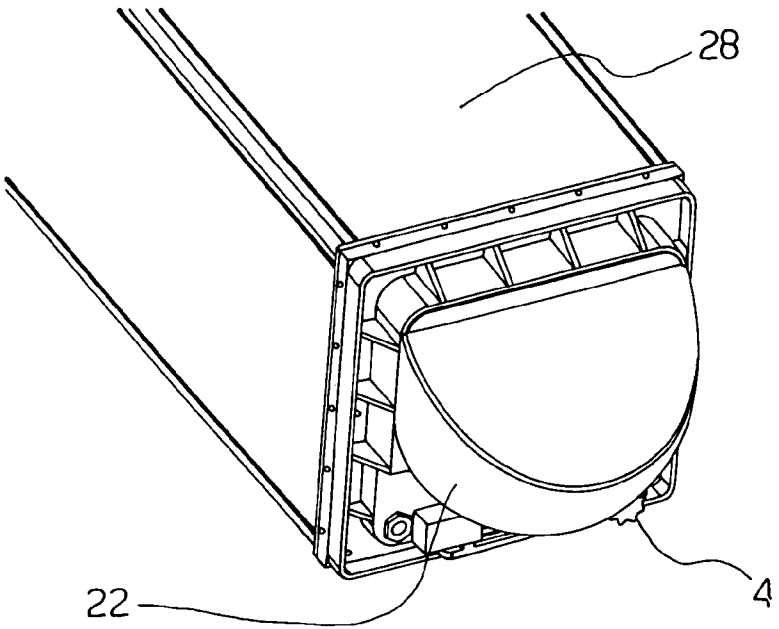

With reference to FIGS. 1 and 2, casing K in turn comprises a number of longitudinal lateral walls or panels 1; a number of angle irons or members 2, 41 for connecting panels 1; a front breakthrough hatch 5; and a rear breakthrough hatch 6. A rear portion of casing K, close to the exhaust nozzle of missile 21, is fitted integrally with a jet deflector 7 having an outlet closed by the rear breakthrough hatch, and a concave deflecting surface (FIGS. 11 and 12). Jet deflector 7 provides for deflecting the exhaust gas from the exhaust nozzle of missile 21 in a given direction depending on the geometric characteristics of said concave deflecting surface, and such as to protect the component parts underneath, such as the devices for supporting and adjusting assemblies 28, and the terrain beneath and adjacent to the launch site.

In the embodiment described, front breakthrough hatch 5 is shattered by the nose of missile 21 as it is launched, and, for this reason, is of minimum break resistance when stressed from inside the casing, i.e. by the nose of missile 21, to oppose minimum resistance to expulsion of missile 21. Conversely, the front breakthrough hatch has a high break resistance when subjected to stress or forces from outside, so as to withstand external forces (wind, blast, pressure, and temperature caused by the launching of adjacent missiles 21). Rear breakthrough hatch 6, on the other hand, is shattered by the exhaust gas produced by the engine of missile 21, is of minimum resistance when stressed from inside casing K, to allow unimpeded outflow of the exhaust gas from the engine of missile 21, and is of greater resistance to external stress, such as wind, blast, pressure, and temperature caused by the launching of adjacent missiles 21.

Figure 13:
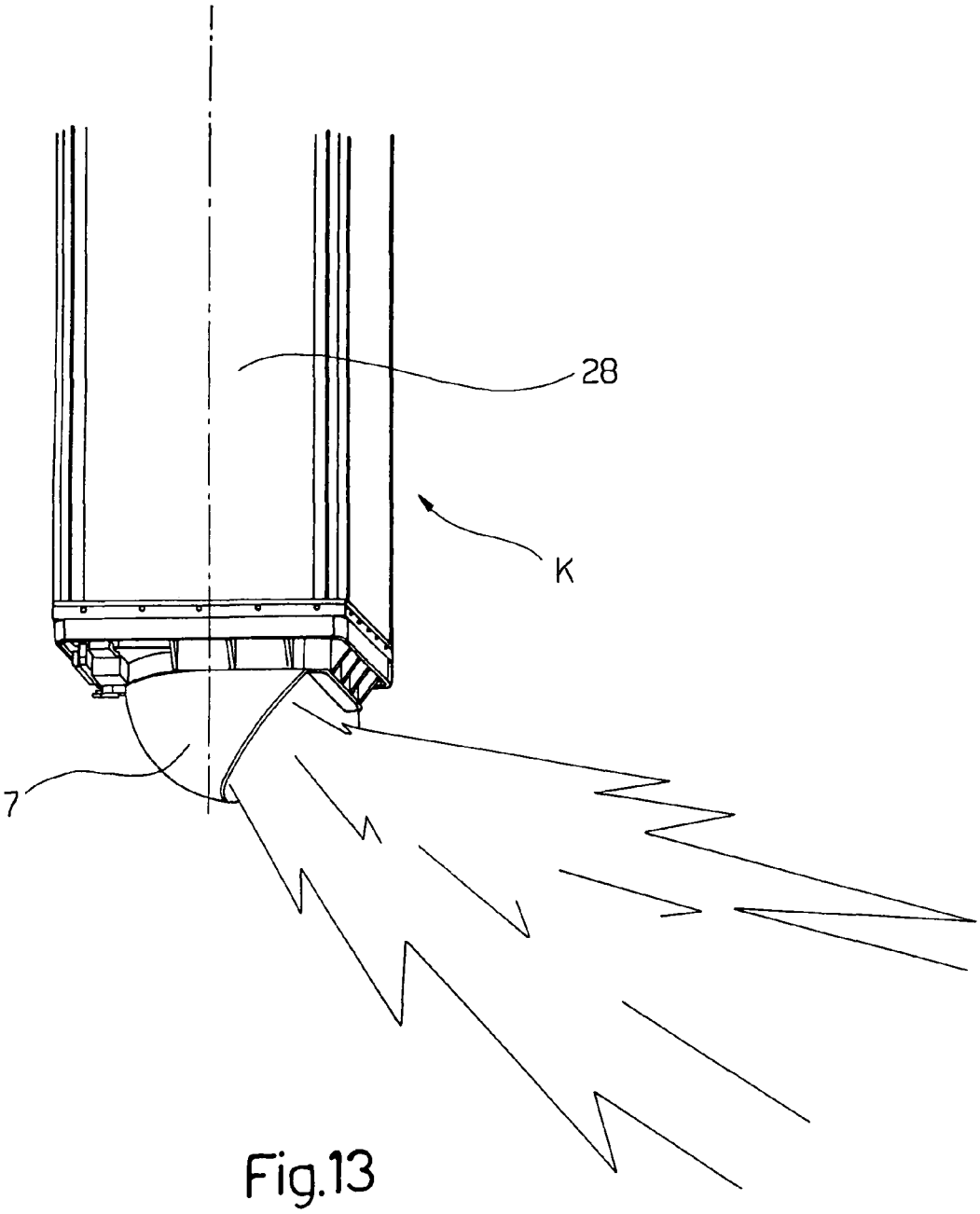
FIG. 13 shows the rear portion and end portion in FIGS. 11 and 12 in an operating condition.

With reference to FIG. 12, jet deflector 7 comprises a metal structure 22 sized to withstand the gas pressure, and shaped to deflect the exhaust gas from missile 21 in a predetermined direction crosswise to the expulsion direction of the missile and coincident with a longitudinal axis of casing K (FIG. 13). In other words, deflector 7 is designed to define a conduit shaped to guide the exhaust gas from missile 21 along a predetermined curved path and far away from the outer casing, to ensure correct operation of the missile rocket engine and prevent damage or injury caused by the exhaust gas shock waves travelling back up to the nozzle of missile 21. With reference to FIG. 12, the guide conduit of deflector 7 is lined with a layer 23 of heat-resistant material to withstand thermal stress, and also with a coating 24 of ablative paint to protect the underlying materials.

Figure 8:
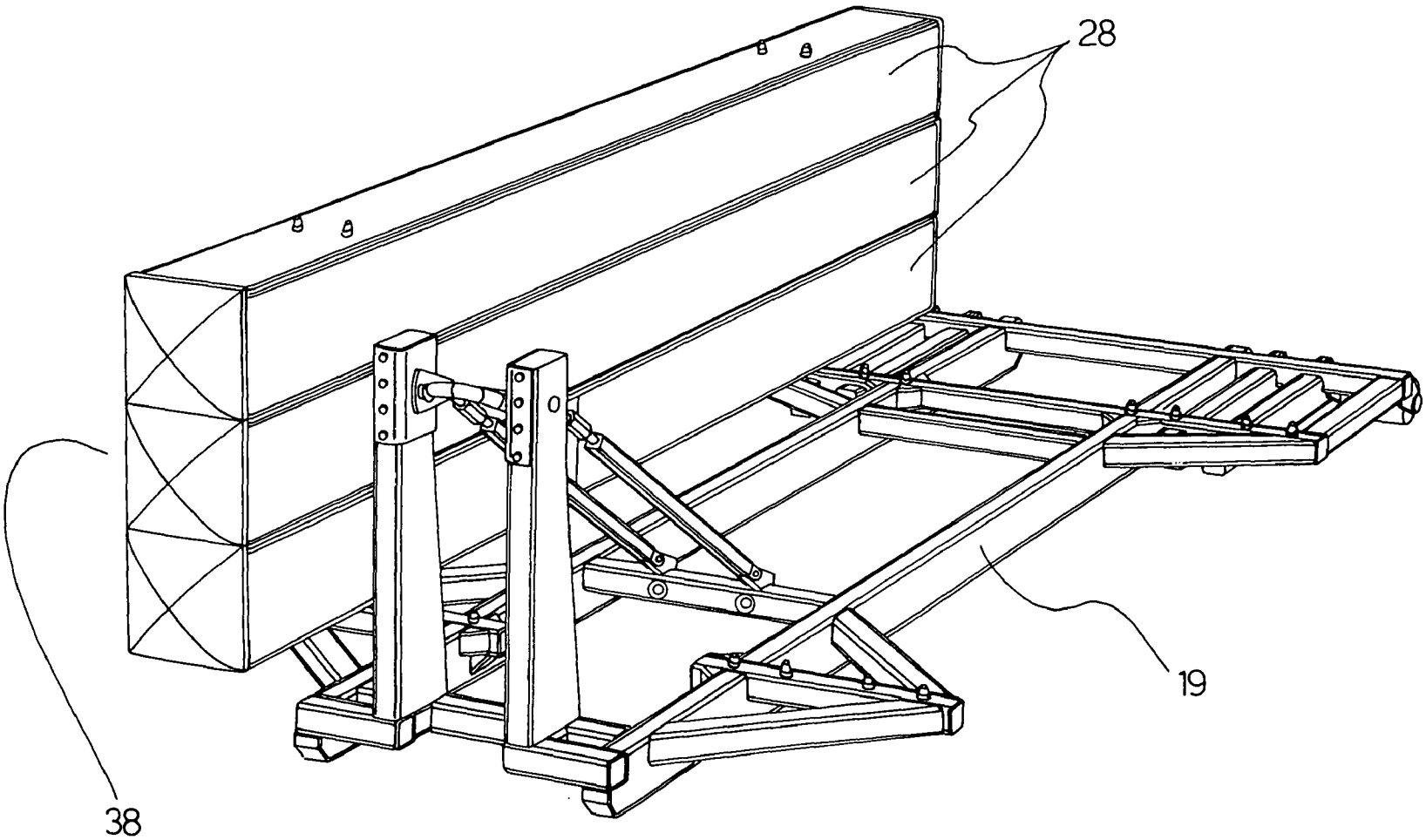
FIG. 8 shows the FIG. 7 platform partly loaded with FIGS. 1 and 2 assemblies.
Figure 9:
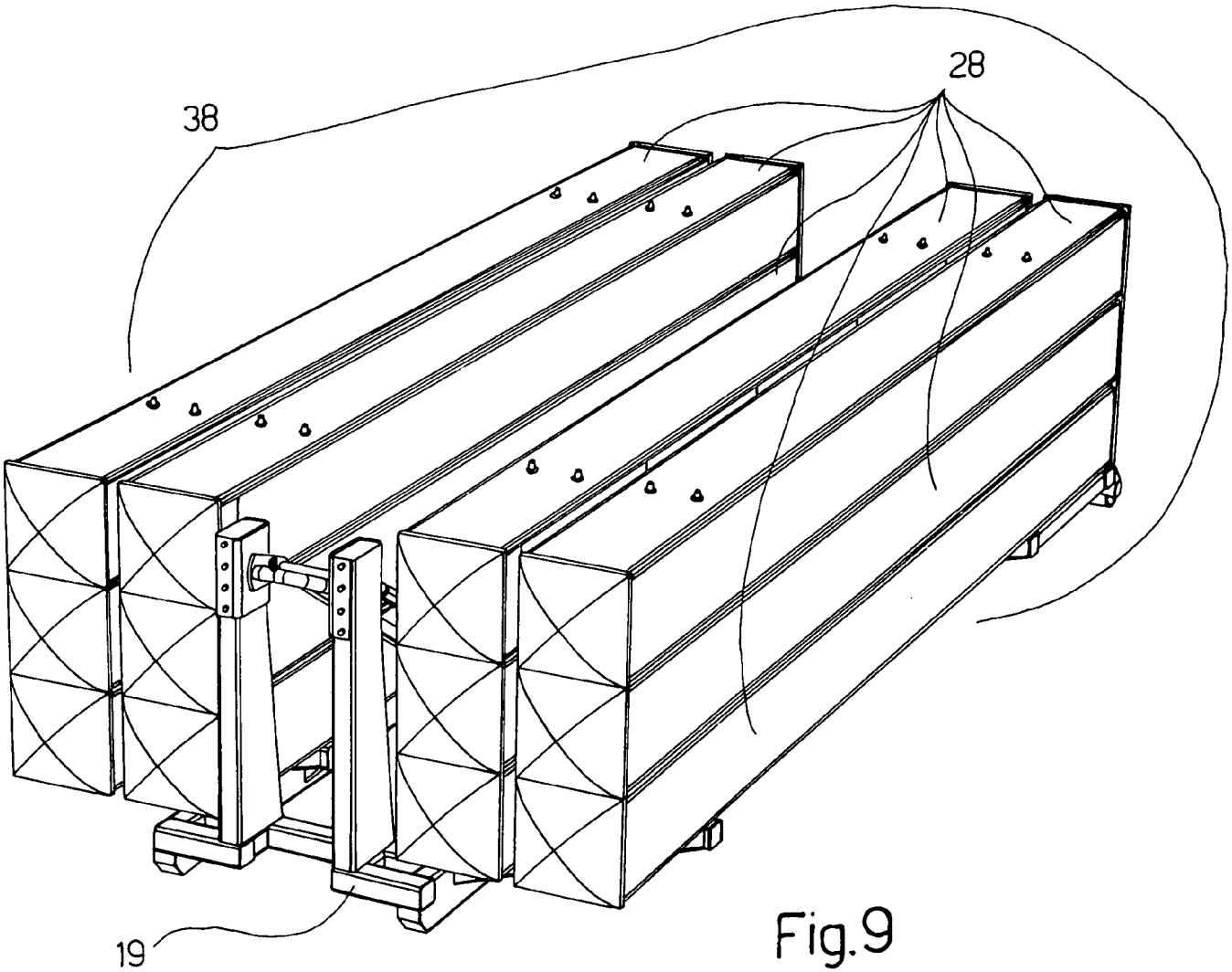
FIG. 9 shows the FIG. 7 platform in a different loading condition.
Figure 10:
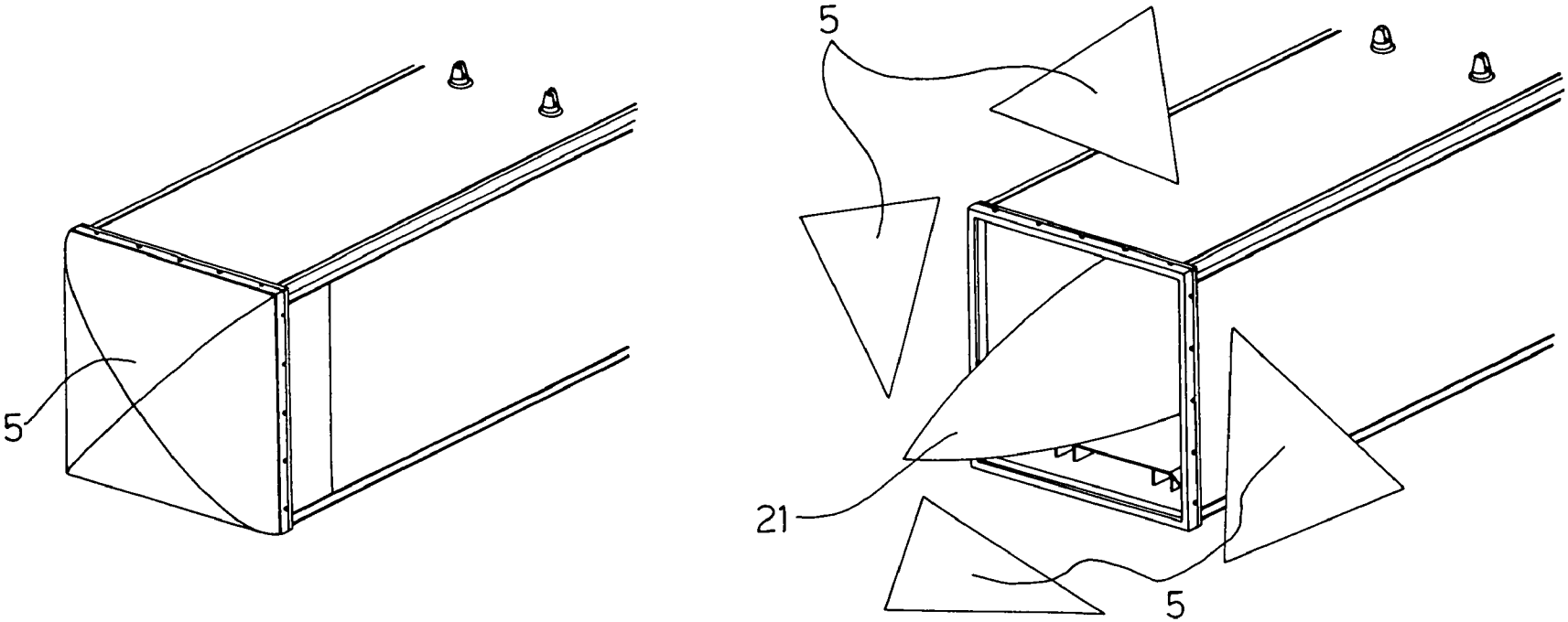
FIG. 10 shows a front portion of the FIG. 1 assembly in two different operating conditions.
Figure 29:
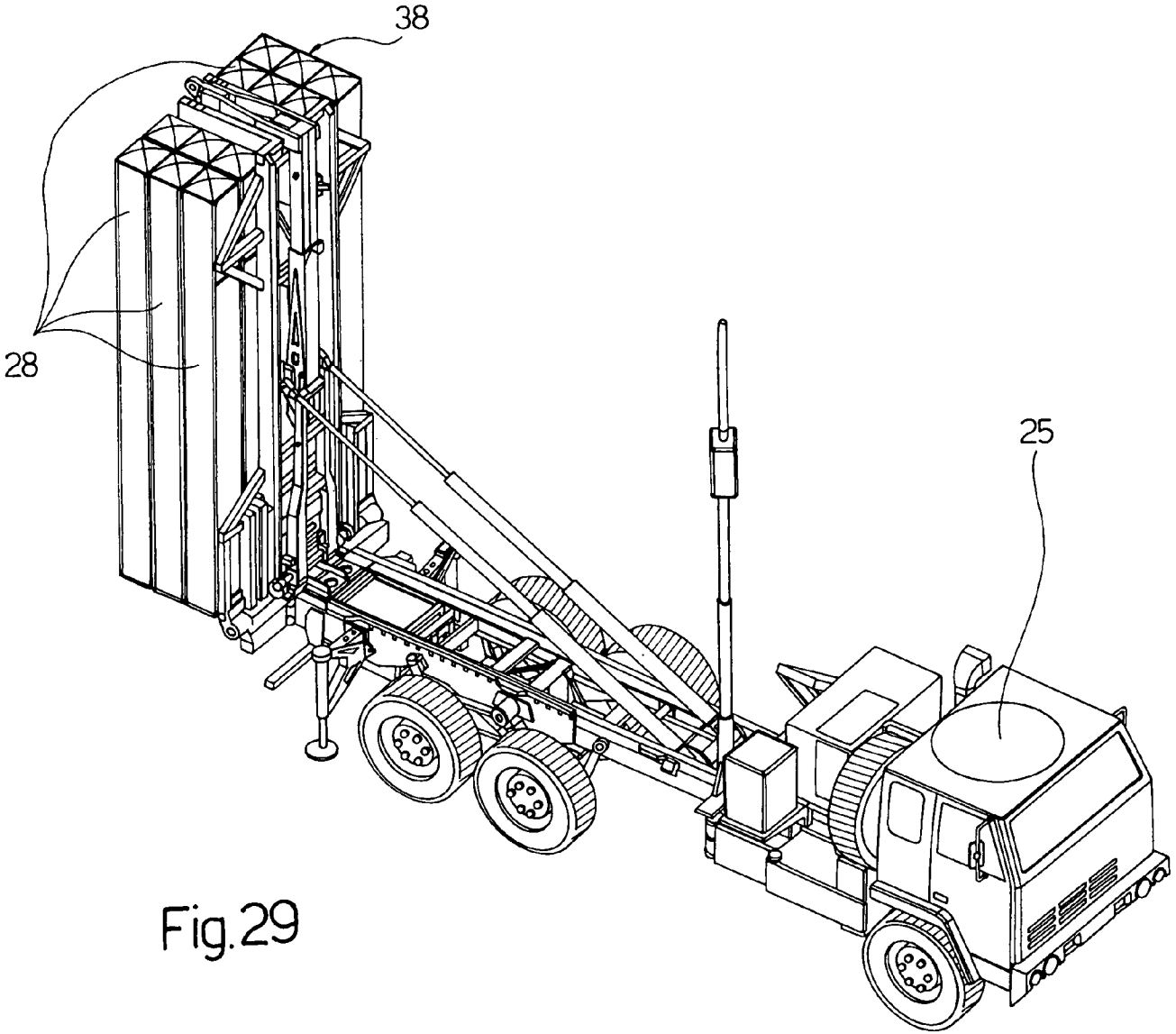
FIG. 29 shows a vehicle for transporting the FIG. 2 assemblies mounted on the FIG. 7 supporting and transportation platform.

As shown in FIGS. 1 and 2 and particularly in FIGS. 3 to 6, modular assembly 28 can be stacked on other modular assemblies 28 and connected stably to the assembly 28 on top or underneath by means of a mechanism 4 (FIG. 12) to define a battery 20 of vertical modules comprising three stacked assemblies 28, as shown clearly in FIGS. 8, 9 and 29.

Figure 3:
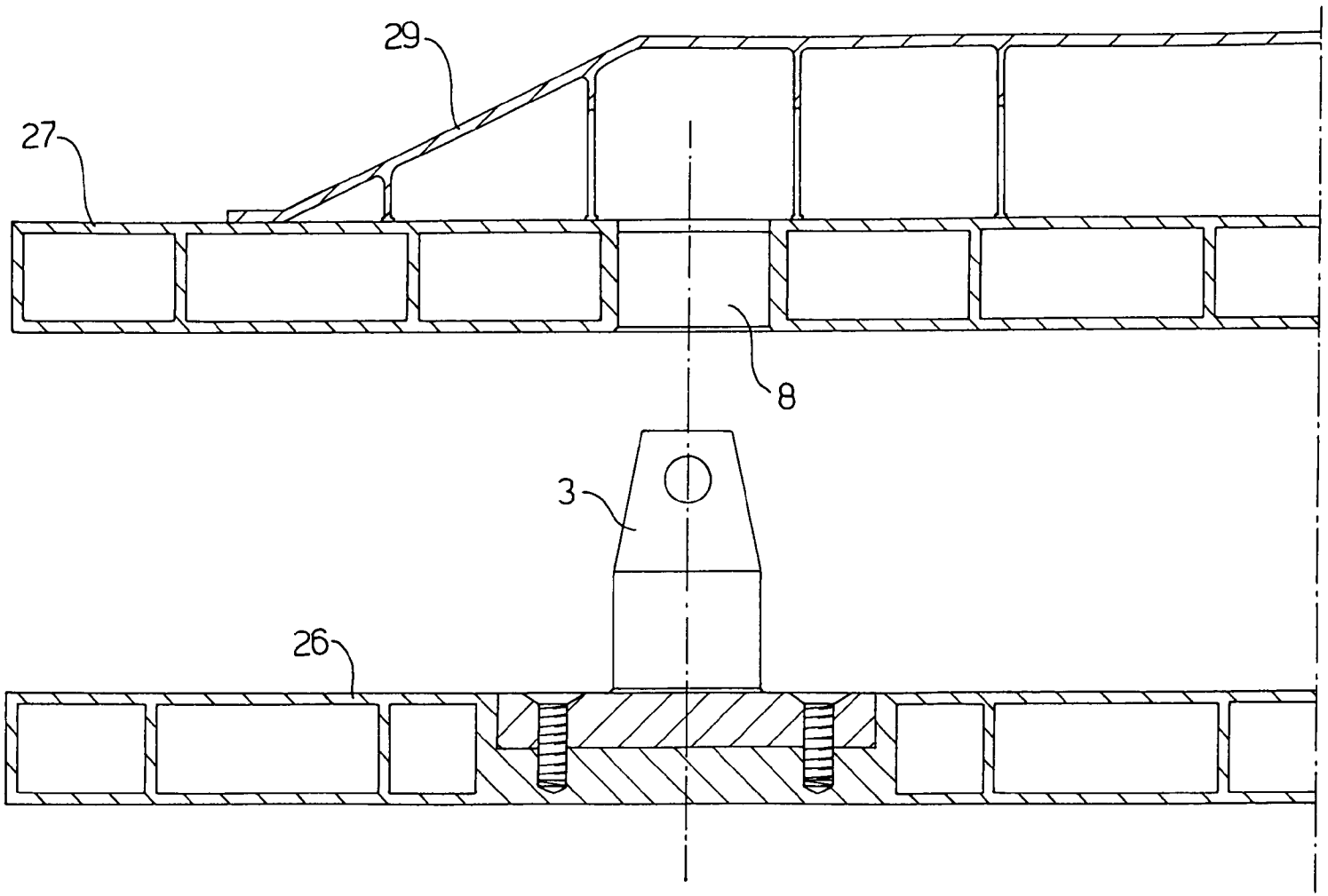
FIG. 3 shows a larger-scale section, with parts removed for clarity, of two different details in FIGS. 1 and 2.
Figure 4:
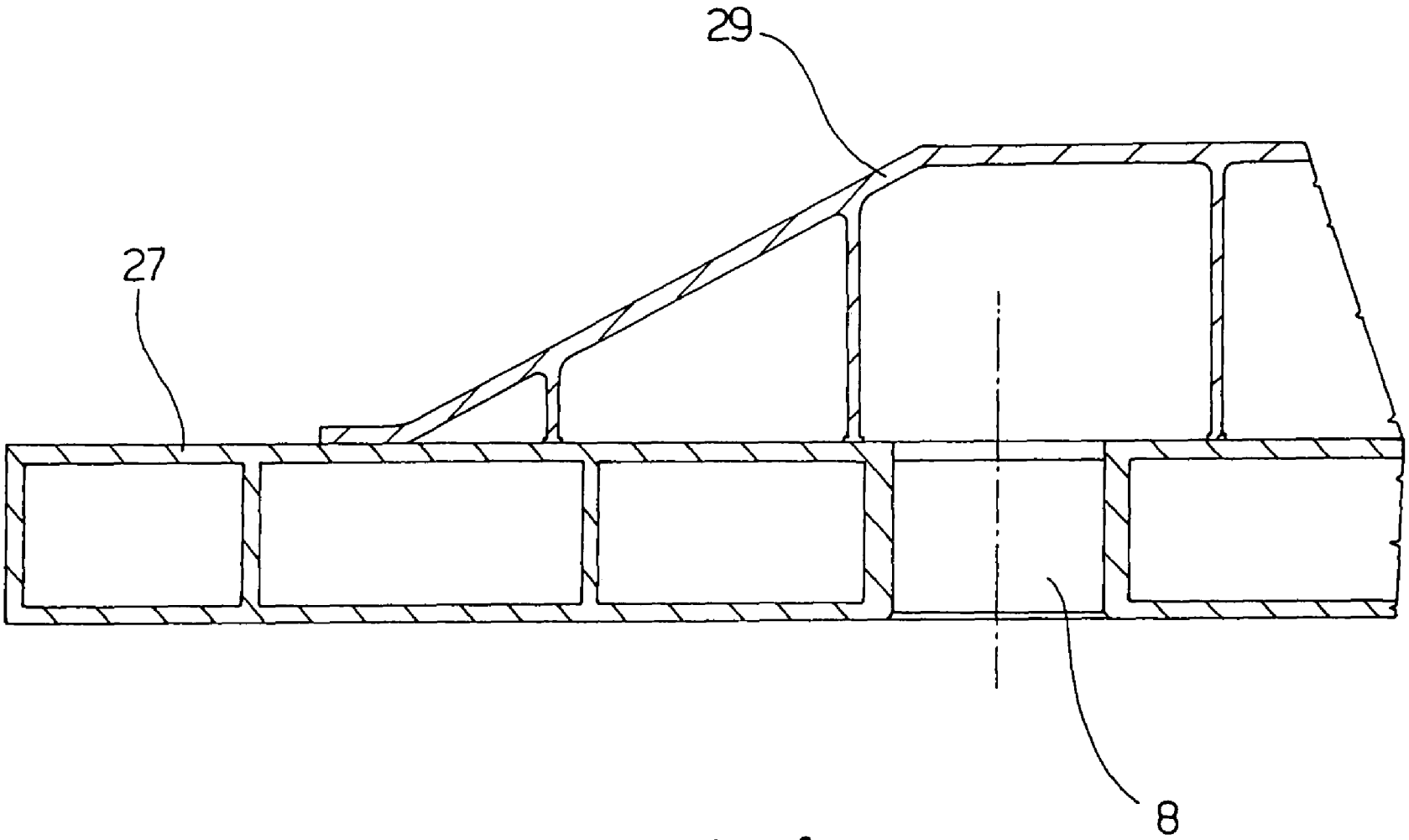
FIG. 4 shows a larger-scale section of a portion of a FIG. 3 detail.
Figure 5:
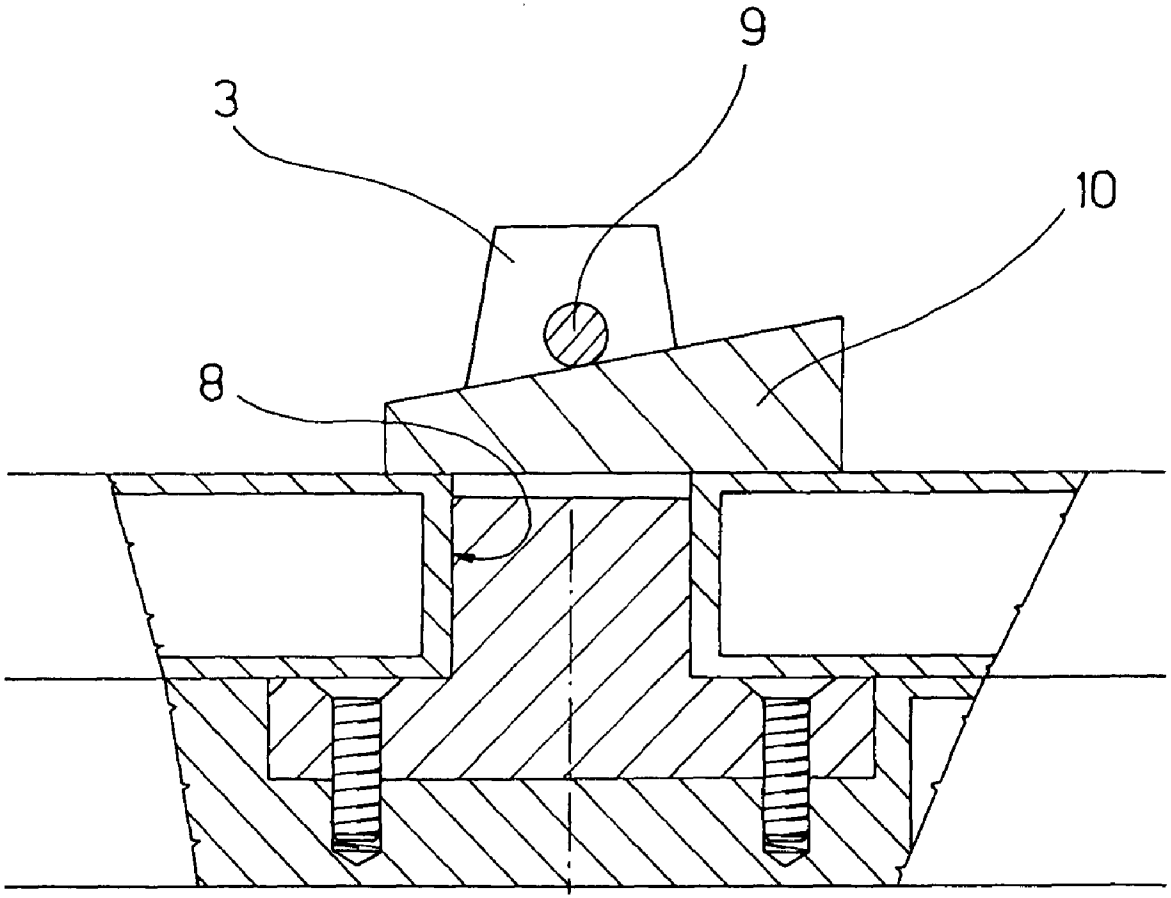
FIG. 5 shows a larger-scale section of two details in FIG. 3.
Figure 26:
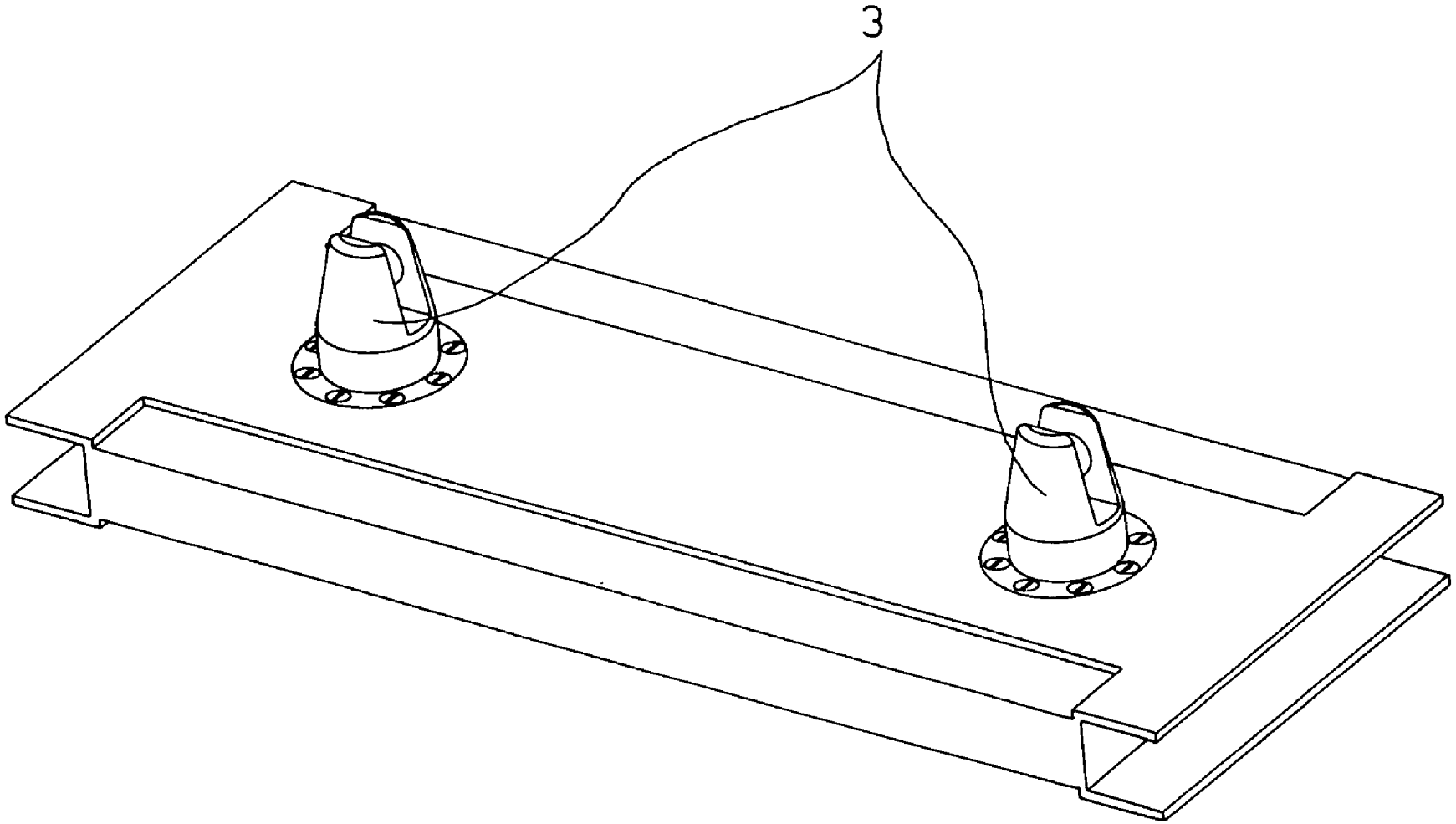
FIG. 26 shows a view on perspective of a detail in FIGS. 1 and 2.
Figure 27:
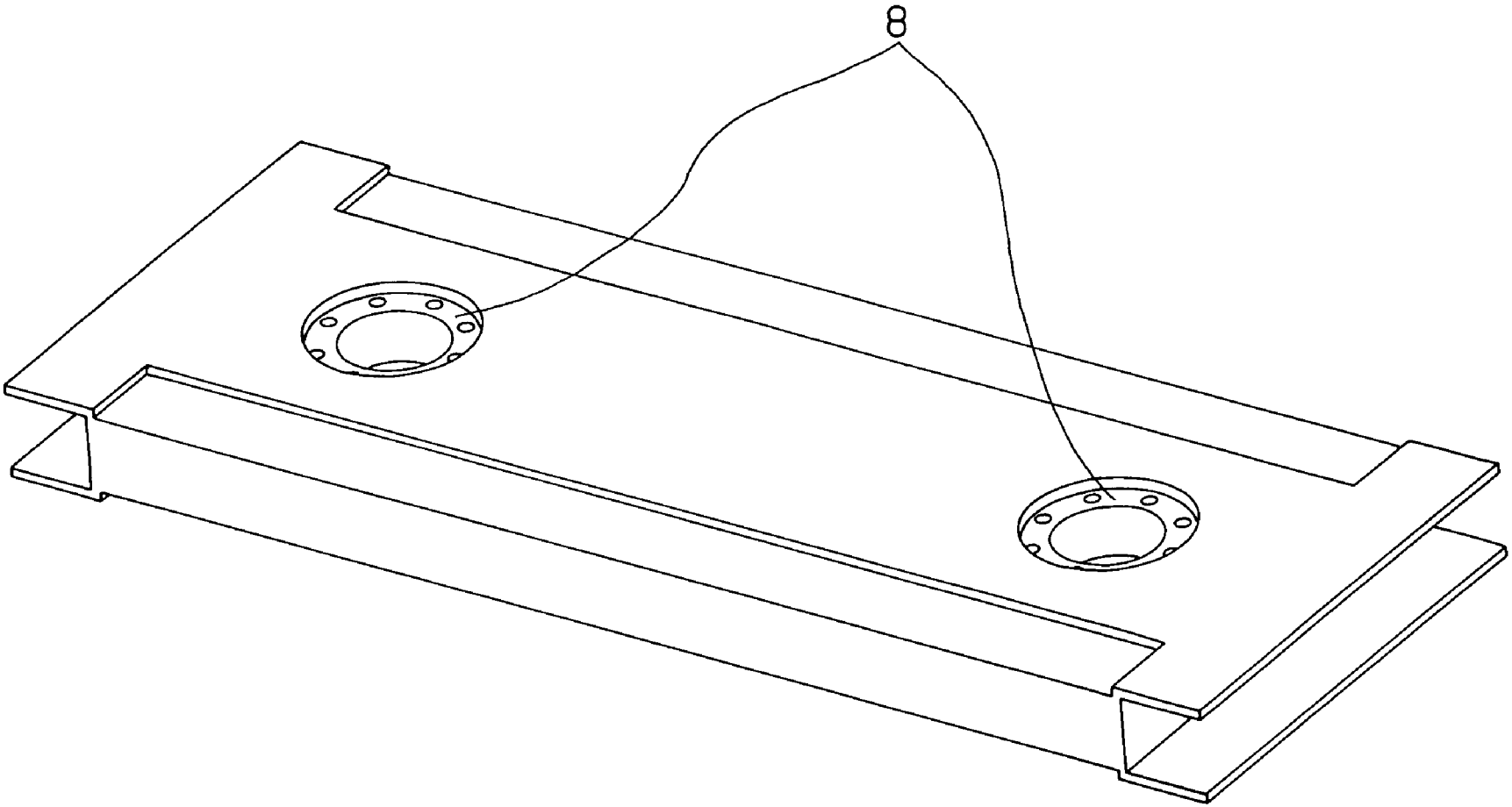
FIG. 27 shows a view in perspective of a further detail in FIG. 1.

For this purpose, each casing K has a locating device and a releasable—in this case, manually operated —connecting device. In the example described, the locating device comprises two pairs of locating pins 3, which project from the same wall or panel 1 (FIGS. 1 and 2), and each of which has a substantially cylindrical base, and an end portion tapering at an angle of substantially 25°. When two casings K are placed one on top of the other, the base of each pin 3 engages a respective locating seat 8 formed in the wall or panel 1 of each casing K facing the wall 1 from which pins 3 extend (FIG. 5). As shown in FIGS. 3 to 5 and particularly in FIGS. 26 and 27, pins 3 and seats 8 are each stably connected, conveniently by means of screws, to a respective plate member or supporting plate, in turn connected stably to the relative wall or panel by welding or other equivalent connecting means (FIG. 3).

With reference to FIG. 3, each pin 3 comprises an end portion, which projects beyond respective seat 8 into a protective casing 29, and has a diametrical slot fitted through with a pin 9. The retaining device, of which pins 3 together with respective pins 9 form part, extends inside protective casing 29, i.e. adjacent to seats 8, and comprises, for each pin 3, a respective tightening wedge 10, which is inserted at least partly inside the slot in relative pin 3, between the bottom of the slot and respective pin 9, to tighten or force the two casings K against each other. Each wedge 10 is movable between a forward tightening position and a withdrawn release position, in which it disengages the relative slot, by a manually operated cam actuating assembly shown in FIG. 6 and also forming part of the retaining device.

Figure 6:
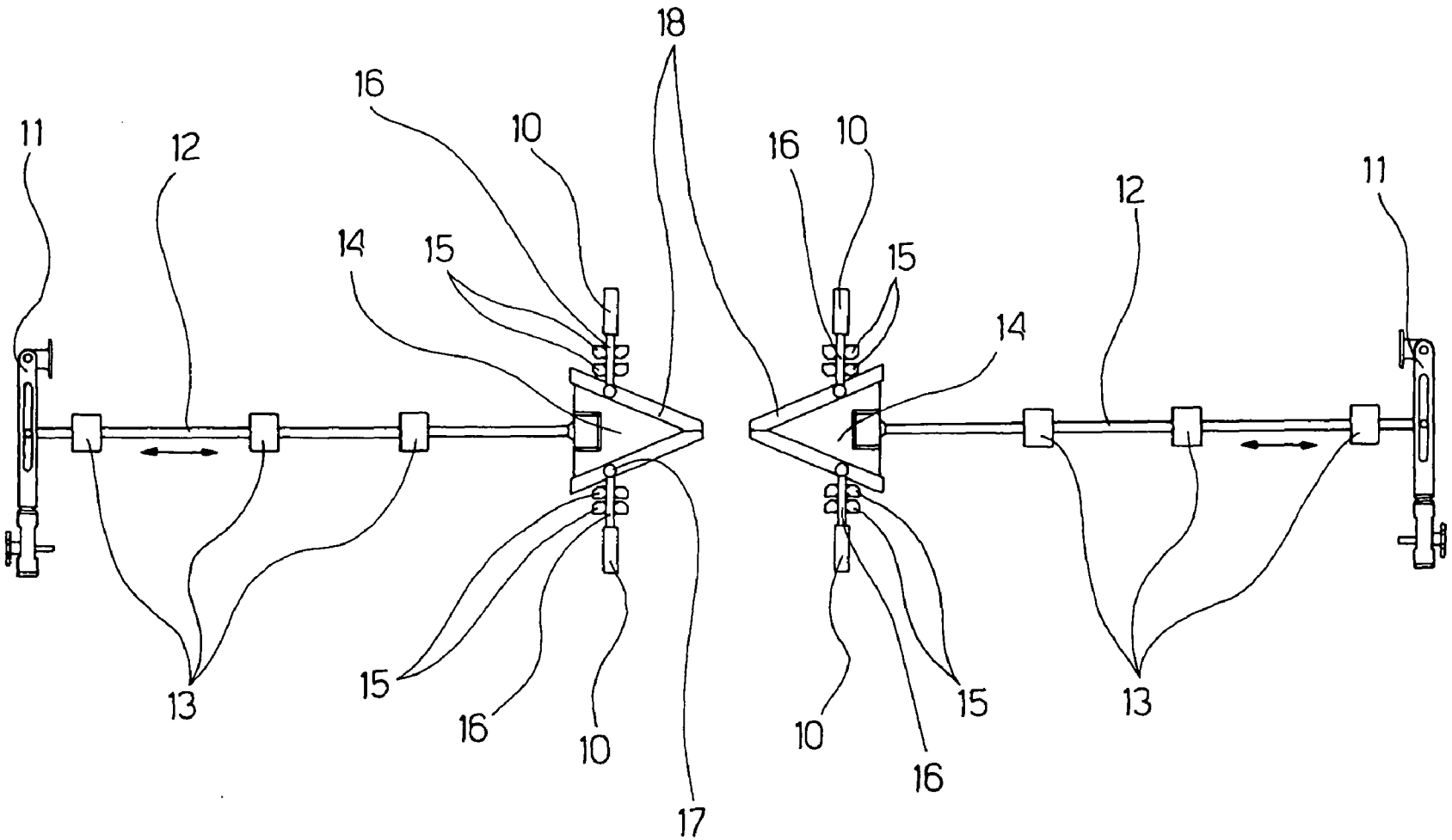
FIG. 6 shows a plan view of a connecting device of the FIG. 1 or 2 assembly.

With reference to FIG. 6, the wedge 10 actuating assembly comprises two actuating levers 11 located outside casing K and hinged to opposite axial end portions of casing K. Each lever 11 is connected to one end of a respective rod 12, which is translated by relative lever 11 along a straight path parallel to the longitudinal axis of casing K and defined by a number of fixed cylindrical guides 13. At the opposite end to that connected to relative lever 11, each rod 12 is fitted with a respective triangular cam member 14, which also moves parallel to the axis of the casing to activate a relative pair of wedges 10 simultaneously. Each wedge 10 is connected to one end of a respective rod 16, which translates inside respective fixed guides 15, and the opposite end of which is connected integrally to a ball 17. The balls 17 forming part of the same triangular member 14 run inside guides or channels 18 forming a V-shaped path and converging towards the guides 18 of the other triangular member 14.

When levers 11 are operated, rods 12 translate, triangular cam members 14 are moved longitudinally, and the four rods 16 slide inside guides 15 to translate wedges 10 in a direction perpendicular to the translation direction of rods 12.

When two assemblies 28 are placed one on top of the other (as shown, for example, in FIG. 8 or 9), pins 3 of the bottom assembly 28 engage seats 8 of the top assembly 28, and, in this position, operation of levers 11 moves wedges 10 laterally. More specifically, when the levers are perpendicular to rods 12, wedges 10 are safely inserted inside pins 3 and the casings are connected; whereas, when levers 11 are or are nearly parallel to rods 12, wedges 10 are not inserted inside pins 3, so that assemblies 28 are disconnected and can therefore be removed or replaced. Simply observing the position of levers 11 is therefore sufficient to determine whether or not assemblies 28 are connected, with no additional control devices required.

As designed, the devices described therefore provide for stacking various assemblies 28 in given relative positions, and for locking them stably to one another in fixed, one-only, relative positions (FIG. 9). In addition to locating and locking two superimposed assemblies 28, pins 3 also provide for easy handling of assemblies 28, by defining attachments by which to attach one or more assemblies 28 to the lift hooks of material-handling machines such as cranes, bridge cranes, etc.

Figure 7:
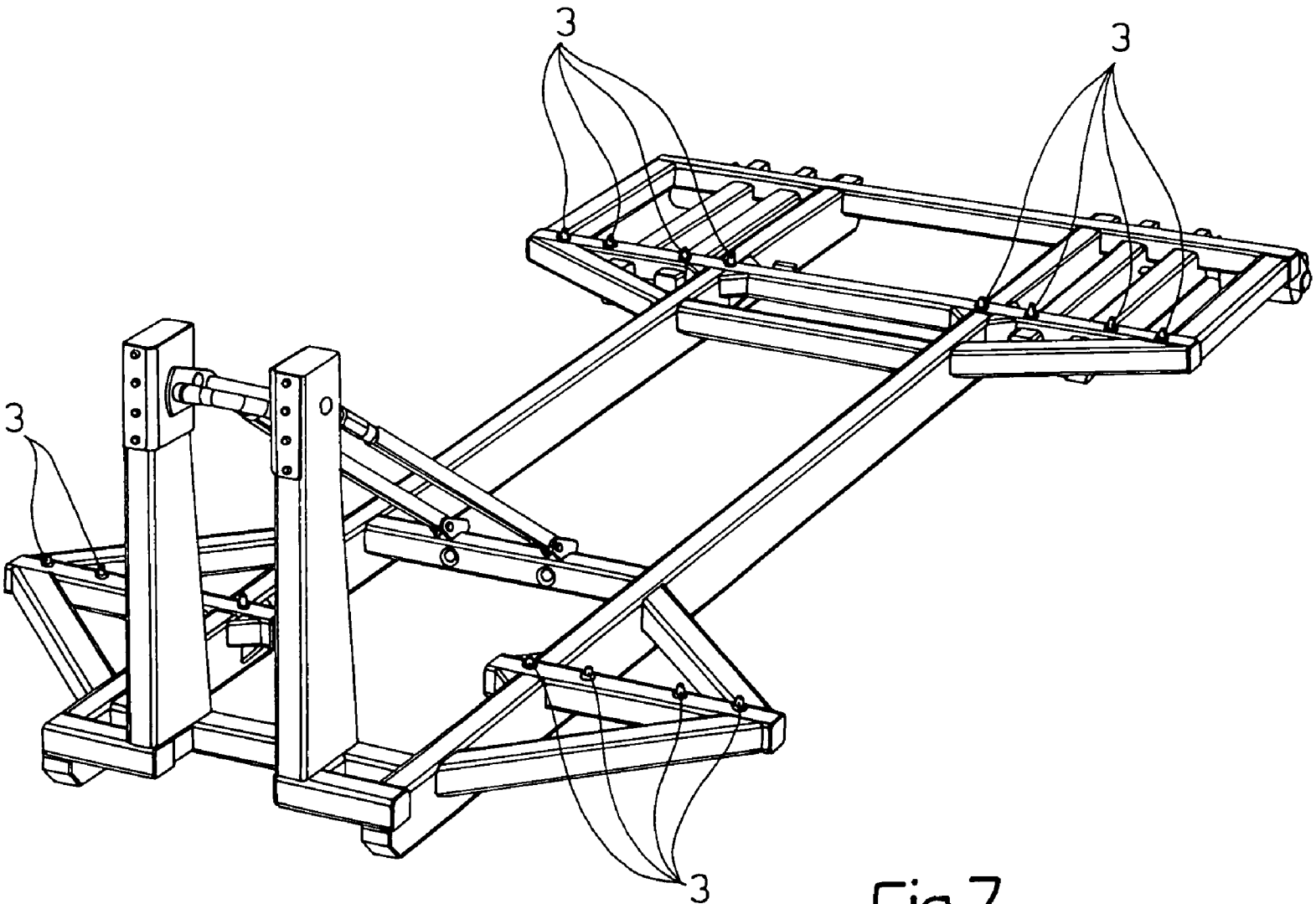
FIG. 7 shows a view in perspective of a platform for supporting and transporting the FIGS. 1 and 2 assemblies.

According to the invention, assemblies 28 are preferably stacked on a platform 19, which supports assemblies 28, performs both a transportation and launching function, and, together with assemblies 28, forms part of a ground launcher. Platform 19 is shown in FIG. 7, and FIGS. 8 and 9 show two different groups of square-section assemblies 28, also known as multitube containers.

To position groups 38, and therefore assemblies 28, in a given one-only position with respect to platform 19, and to lock groups 38 releasably to platform 19, platform 19 is fitted integrally with a number of locating pins 3 arranged in pairs to engage seats 8 in the casings K contacting the top supporting surface of platform 19. Once positioned by pins 3 inserted inside seats 8, the assembly 28 contacting the platform is made integral with platform 19 by the wedge locking device described above and housed inside casing K of the assembly 28 contacting platform 19.

In FIG. 29, platform 19 has an end portion hinged to a rear frame portion of a self-propelled transport vehicle 25, and is rotated, about an axis perpendicular to a longitudinal axis of the vehicle, between a lowered transport position and a raised launch position by a conveniently hydraulic linear actuator (FIG. 29), thus obtaining a self-propelled ground launcher in which the missiles are oriented by straightforward linear actuators.

Figure 14:
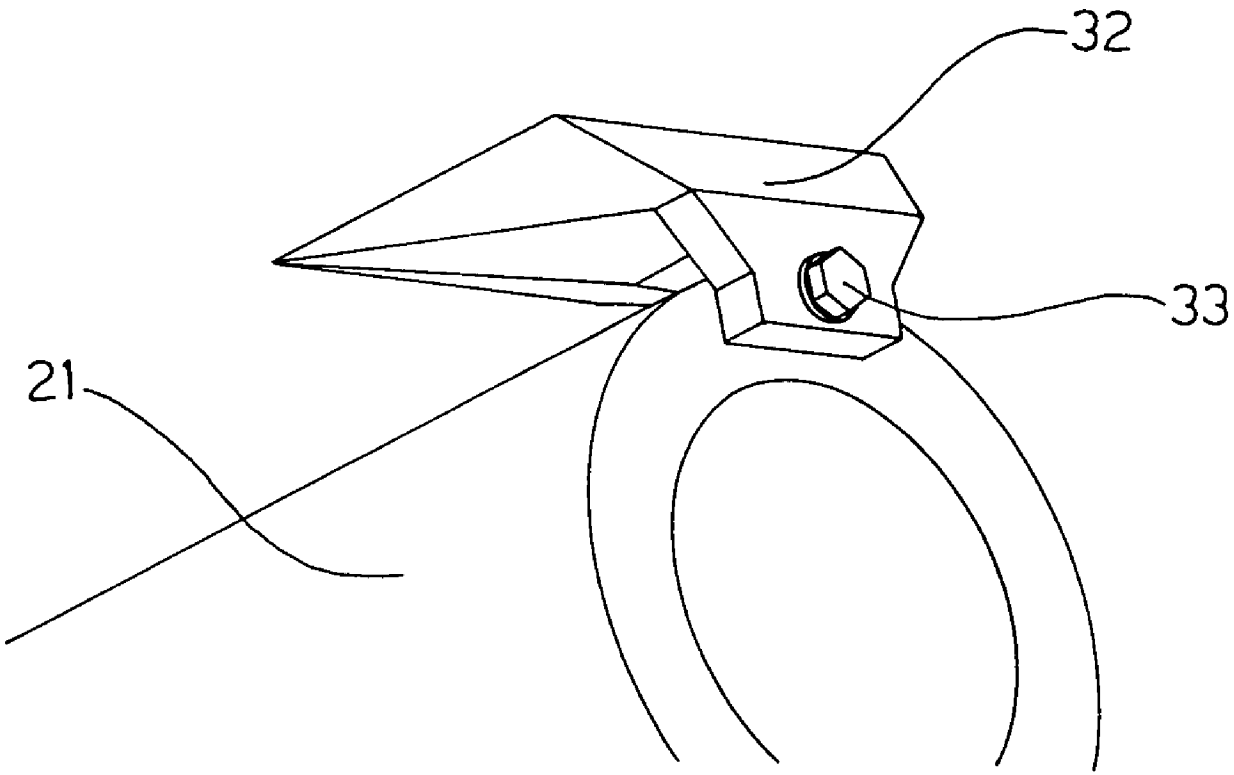
FIGS. 14 and 15 show views in perspective of two different retaining devices of the FIGS. 1 and 2 assembly.

As shown in FIG. 14, each missile 21 housed in respective casing K has a respective minimum-thrust retaining device conveniently located close to a rear portion of missile 21, and which comprises a fastening member 32 for attachment to a portion of casing K, and a break-off member 33 connecting member 32 to missile 21. The minimum-thrust retaining device provides for retaining missile 21 until the engine supplies a given thrust ensuring correct launching of the missile.

When the engine of missile 21 reaches a given thrust, e.g. 1000 daN, break-off member 33 breaks off to release missile 21.

Figure 15:
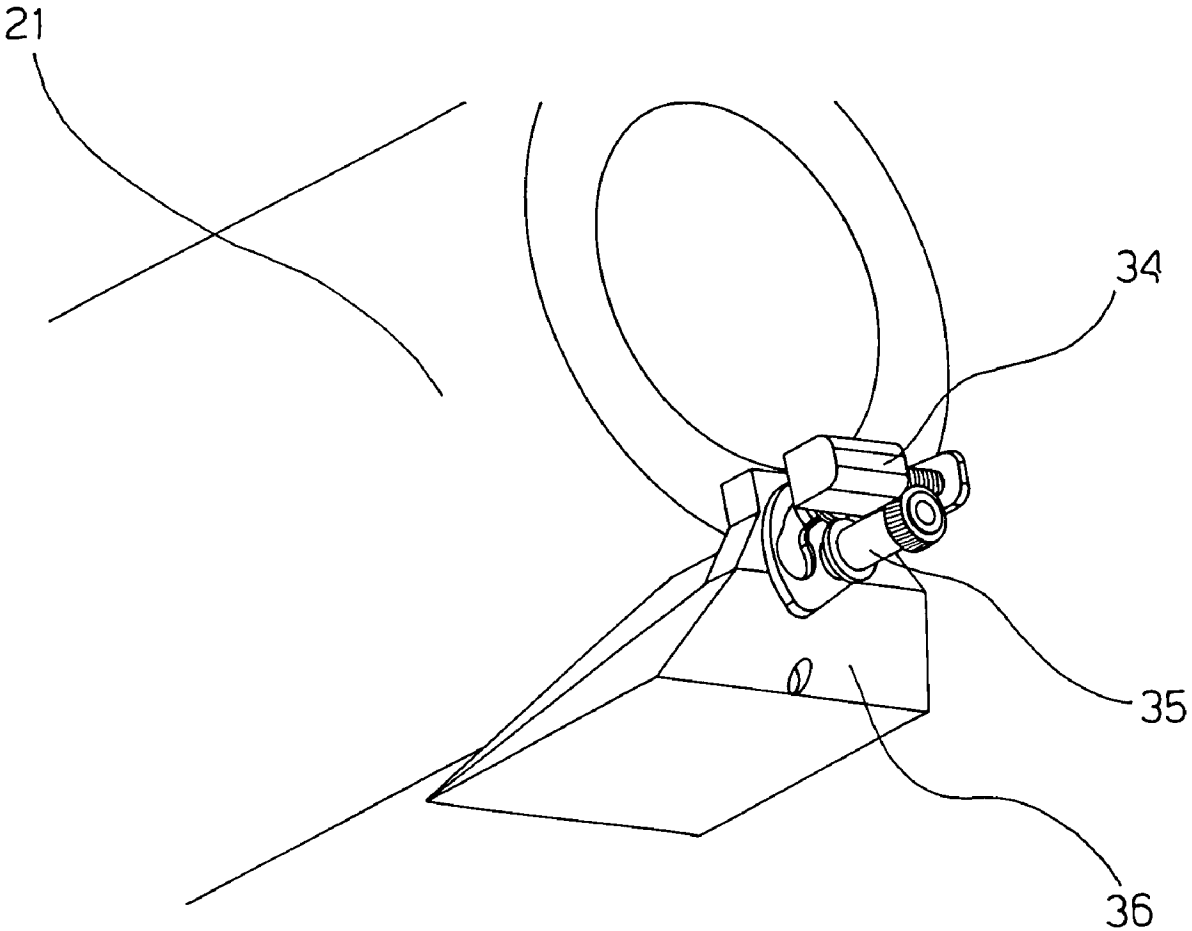

FIG. 15 shows a maximum-thrust retaining device, also preferably connected to a rear portion of relative missile 21 and housed inside relative casing K, and which comprises a fastening member 36 for attachment to casing K, a movable member 35 for releasably connecting member 36 to missile 21, and an electric motor 34 for enabling and disabling the maximum-thrust function. More specifically, motor 34 is controlled to rotate movable member 35 between a retaining position and a release position.

The maximum-thrust retaining device provides for retaining the missile even when the engine is at maximum thrust, normally 6000 daN. The maximum-thrust retaining device is therefore a safety device to prevent the missile being launched in the event of involuntary ignition of the engine. Prior to voluntary ignition of the engine of missile 21, motor 34 rotates member 35, which releases and ensures correct launching of missile 21 following break-off of break-off member 33.

Figure 16:
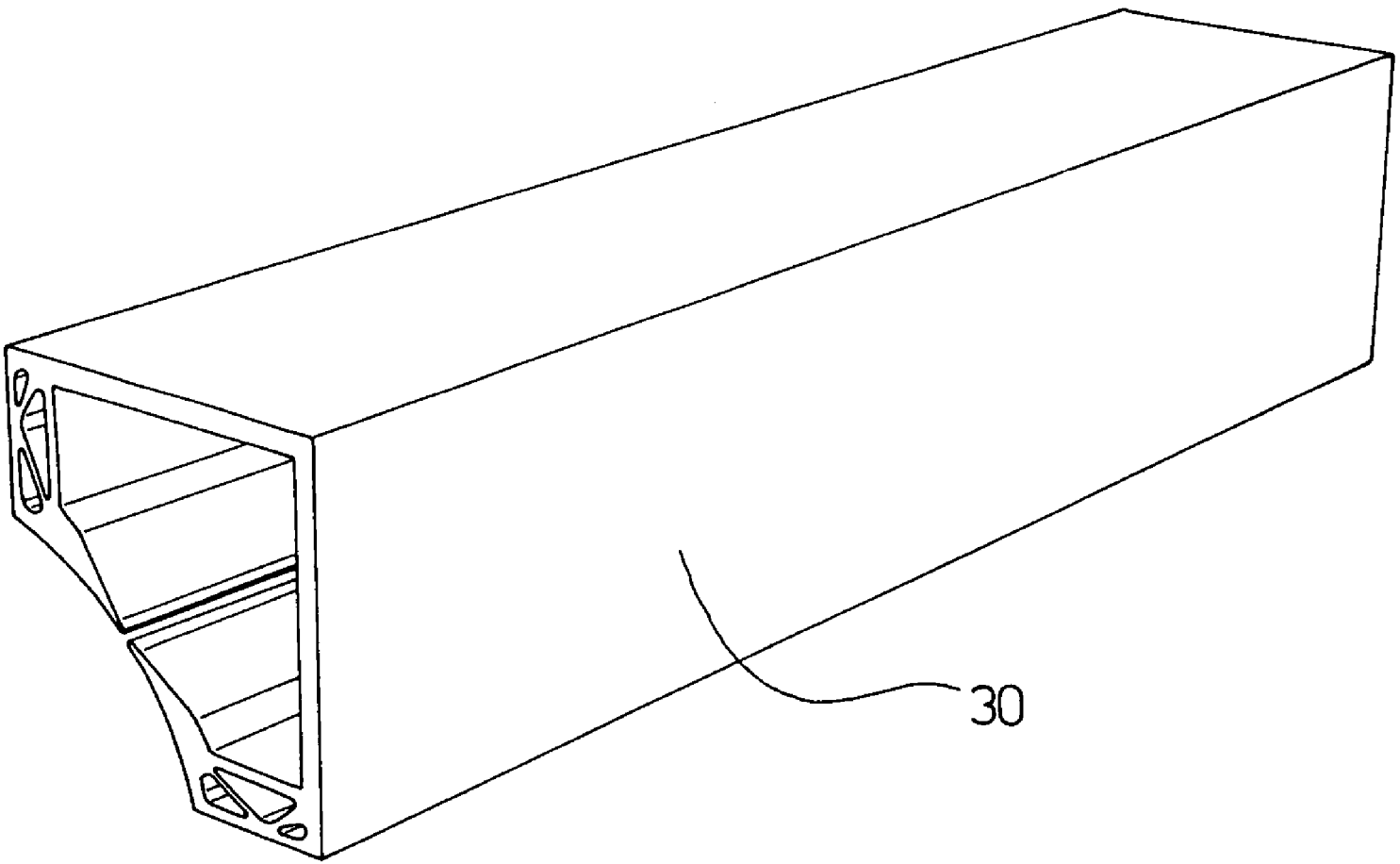
FIGS. 16 and 17 show views in perspective of two different guide details of the FIGS. 1 and 2 assembly.
Figure 17:
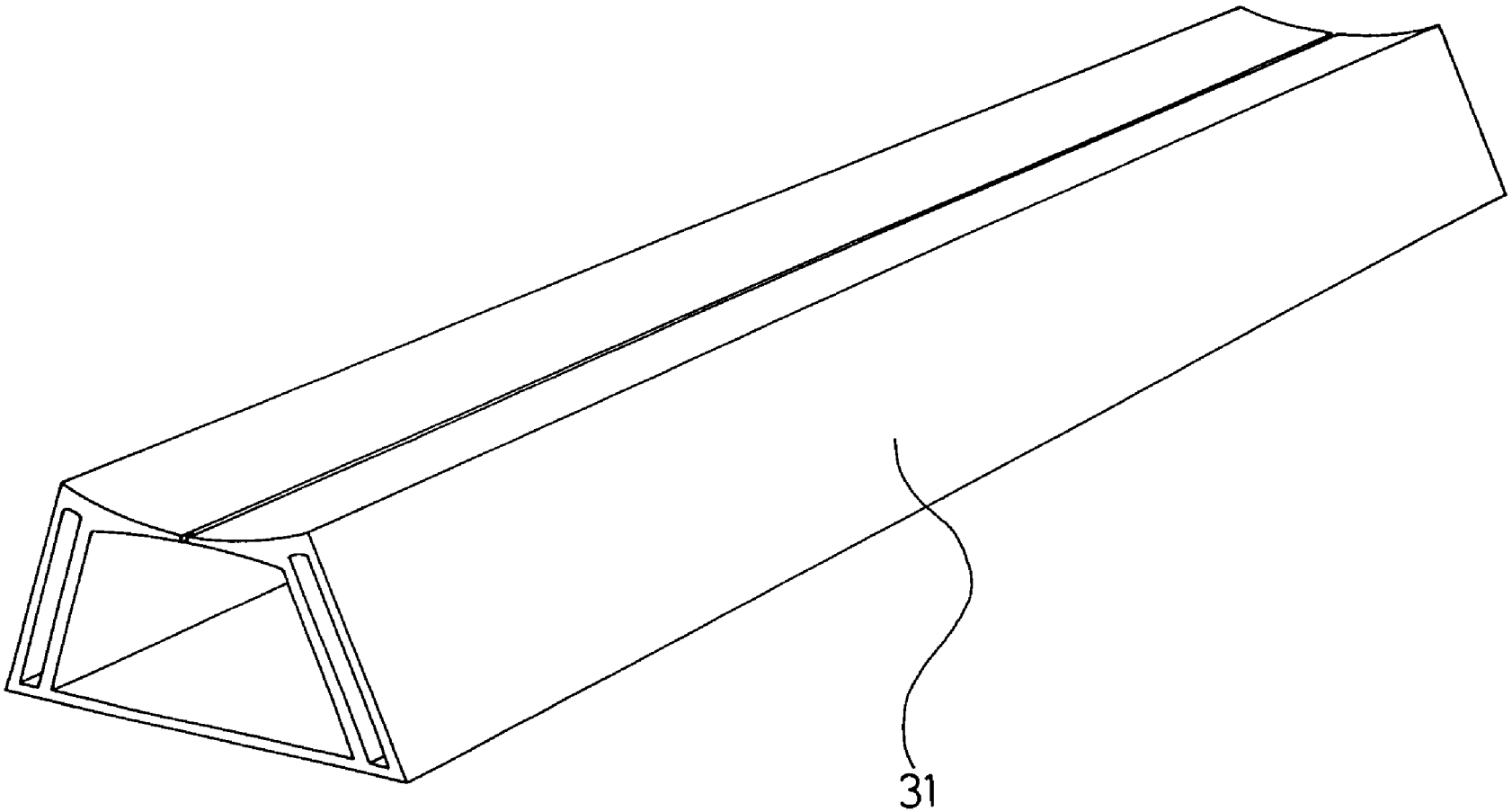
Figure 18:
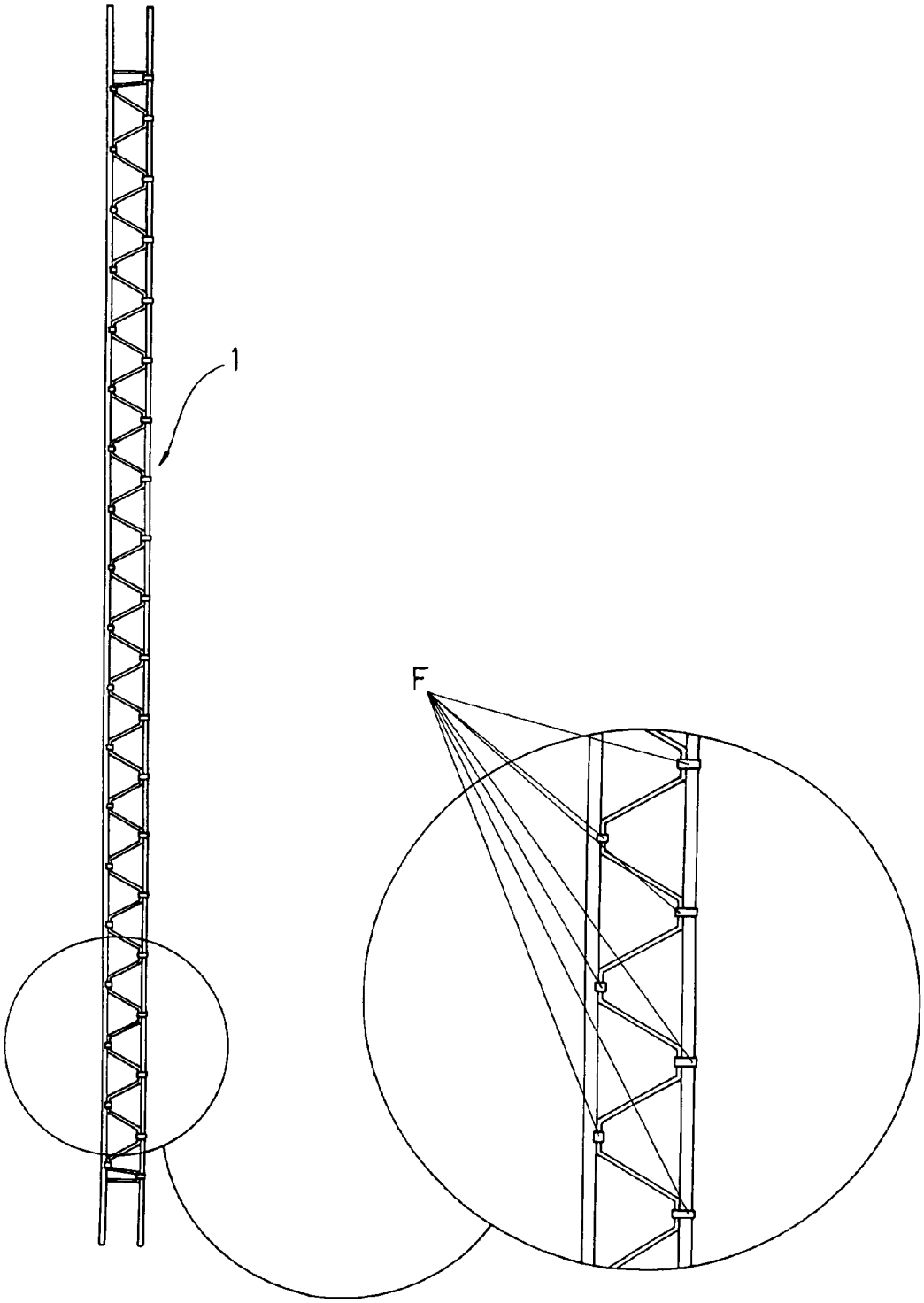
FIG. 18 shows a cross section of a longitudinal panel of the FIGS. 1 and 2 assembly.
Figure 28:
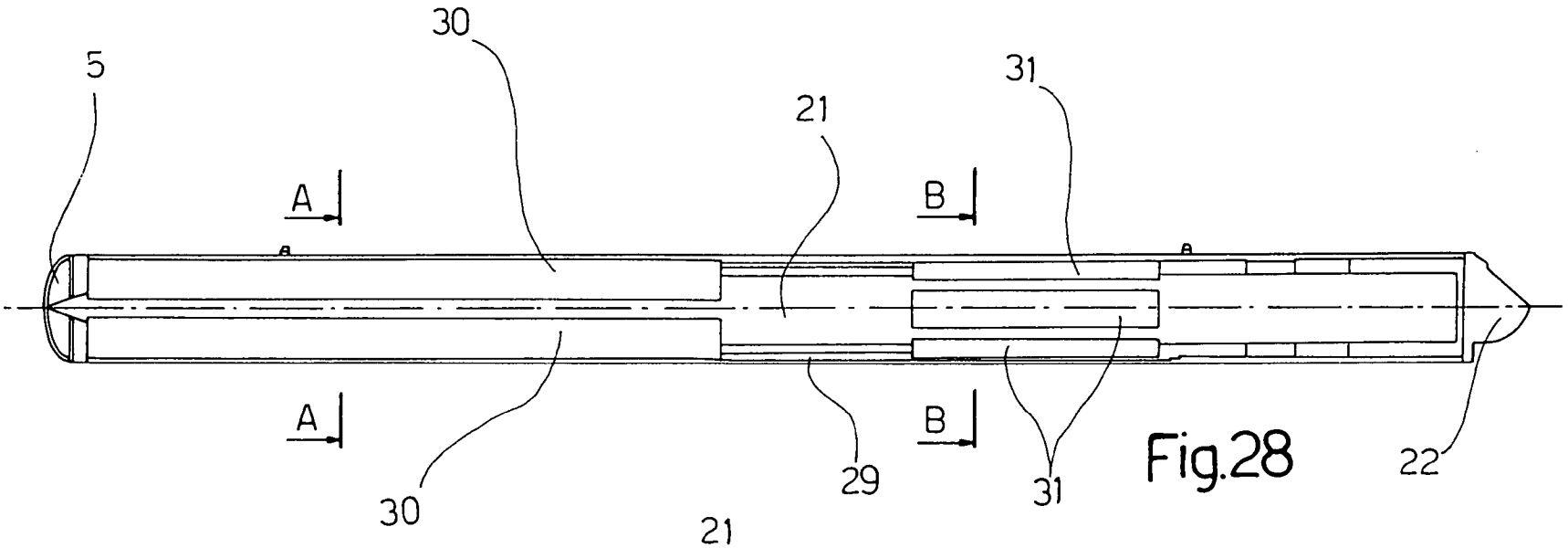
FIG. 28 shows a smaller-scale longitudinal section of the FIG. 1 assembly.
Figure 28B:
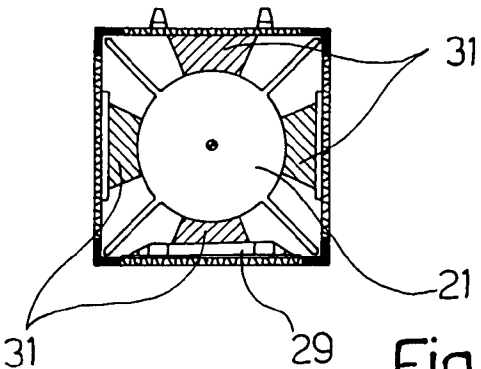
FIGS. 28*a* and 28*b* show two cross sections along lines A-A and B-B respectively in FIG. 28.
Figure 28A:
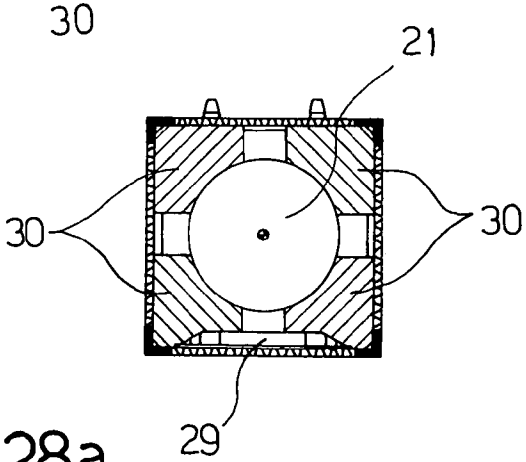

As shown in FIG. 28, each missile 21 is connected to relative casing K in axially-sliding manner by means of a guide assembly comprising a front guide assembly defined by four independent front guides 30 arranged inside casing K as shown in FIG. 28*a*, and a rear guide assembly defined by four independent rear guides 31 arranged in the form of a cross inside casing K as shown in FIG. 28*b*. With reference to FIGS. 16 and 17, front guides 30 and rear guides 31 are conveniently made of polyurethane material or other equivalent material, and are fitted to the inner parts of the casing, including casing 29, to slide in the longitudinal expulsion direction of missile 21. In the example described, the guides are defined by respective ribbed tubular sections bounded on the side facing missile 21 by a concave guide surface. In addition to guiding missile 21 as it is expelled from casing K, the four front guides 30 also provide for breaking front breakthrough hatch 5, when this cannot be broken by the nose of the missile on account of the design or structure of the nose, and for directing the fragments of front breakthrough hatch 5 away from the rest of the casing to prevent damaging the missile. Being independent, front guides 30 are detached rapidly from missile 21 once outside the casing, and are made of damping material to protect missile 21 and its delicate component parts against shock and vibration during transport.

In addition to guiding missile 21 at the launching stage, the four rear guides 31 are also independent to detach rapidly from missile 21 once outside casing K, and, like guides 30, provide for protecting missile 21 and its delicate component parts from shock and vibration during transport. Both the front and rear guides are also designed to reduce the forces transmitted by the missile to the casing at the launching stage.

Figure 19:
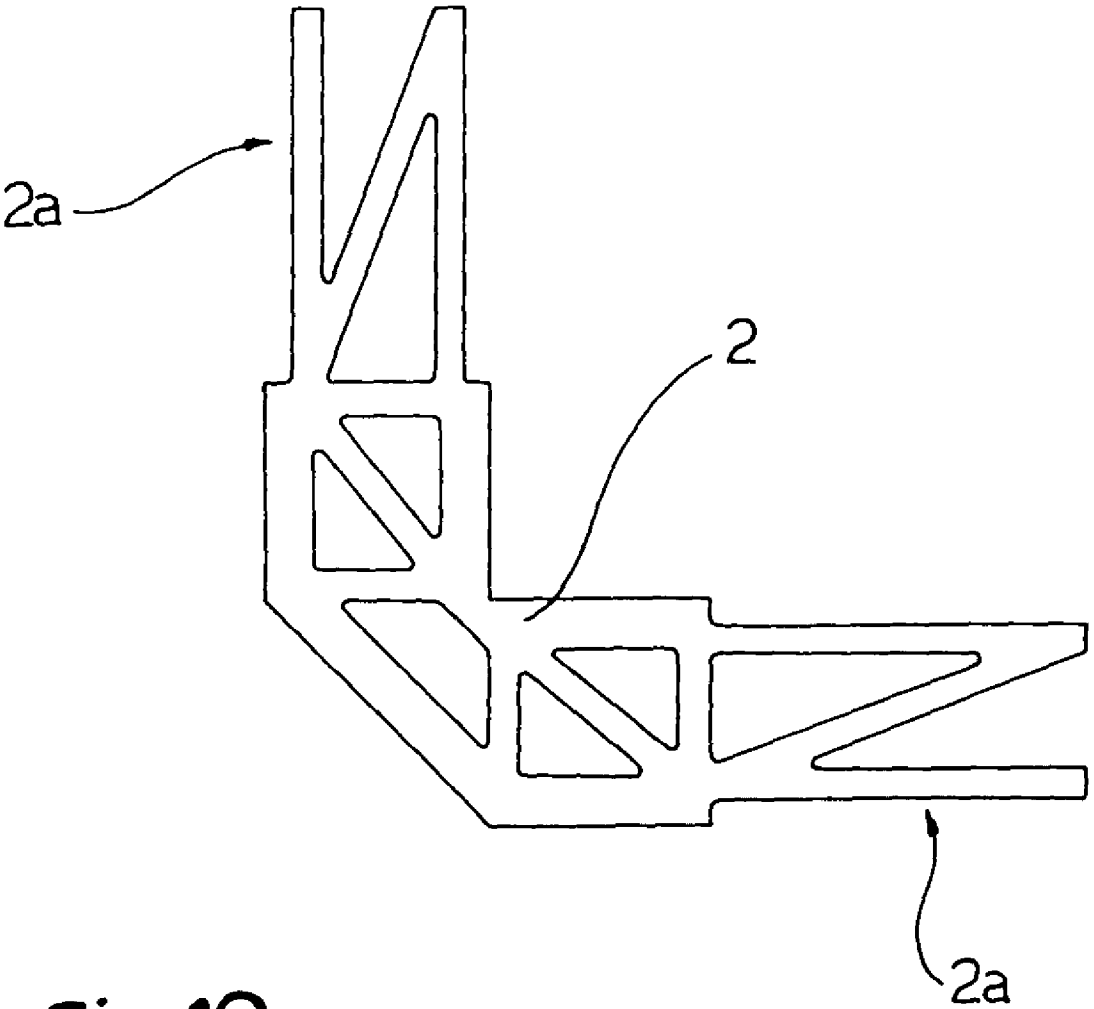
FIG. 19 shows a cross section of an angle iron of the FIGS. 1 and 2 assembly.
Figure 20:
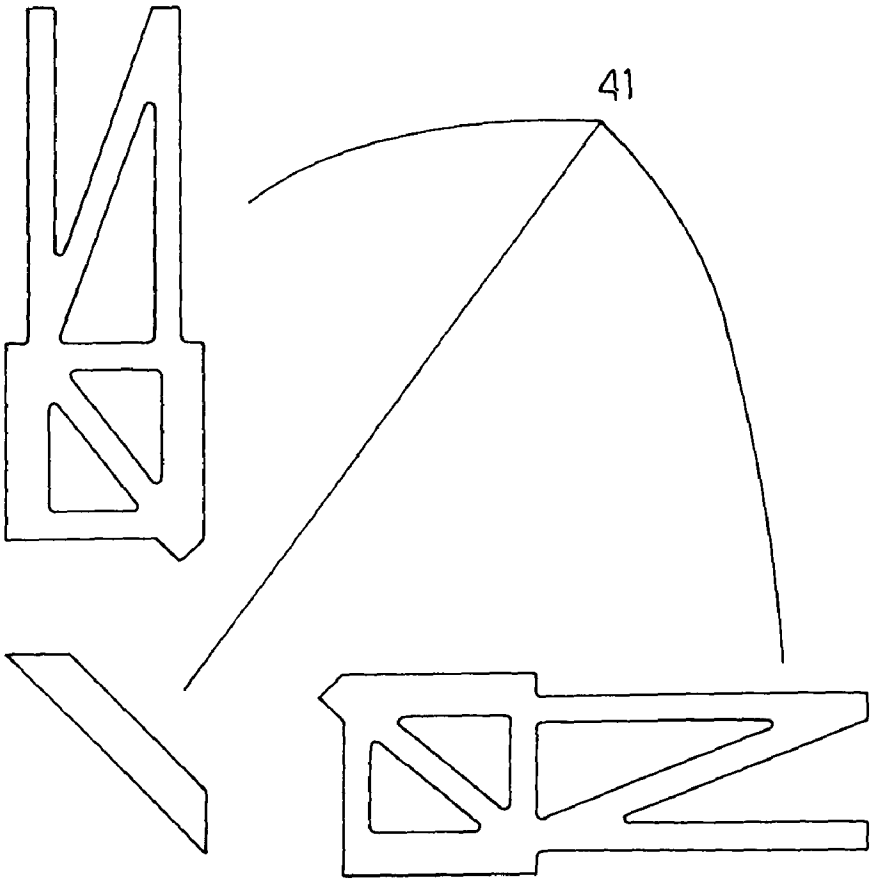
FIG. 20 shows an exploded view of a different embodiment of the FIG. 19 detail.
Figure 21:
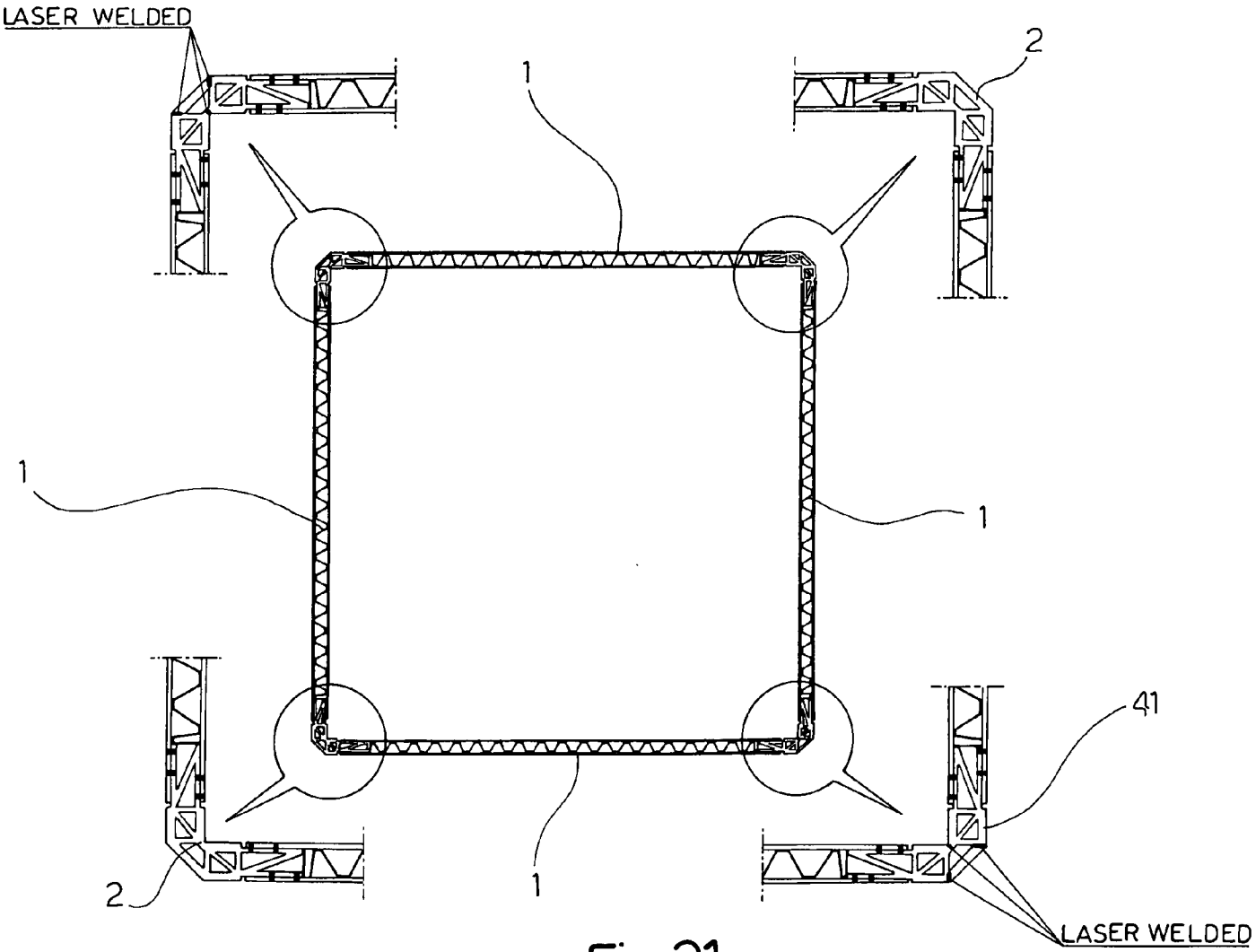
FIG. 21 shows a cross section, with enlargements for clarity, of a further detail in FIG. 1.
Figure 22:
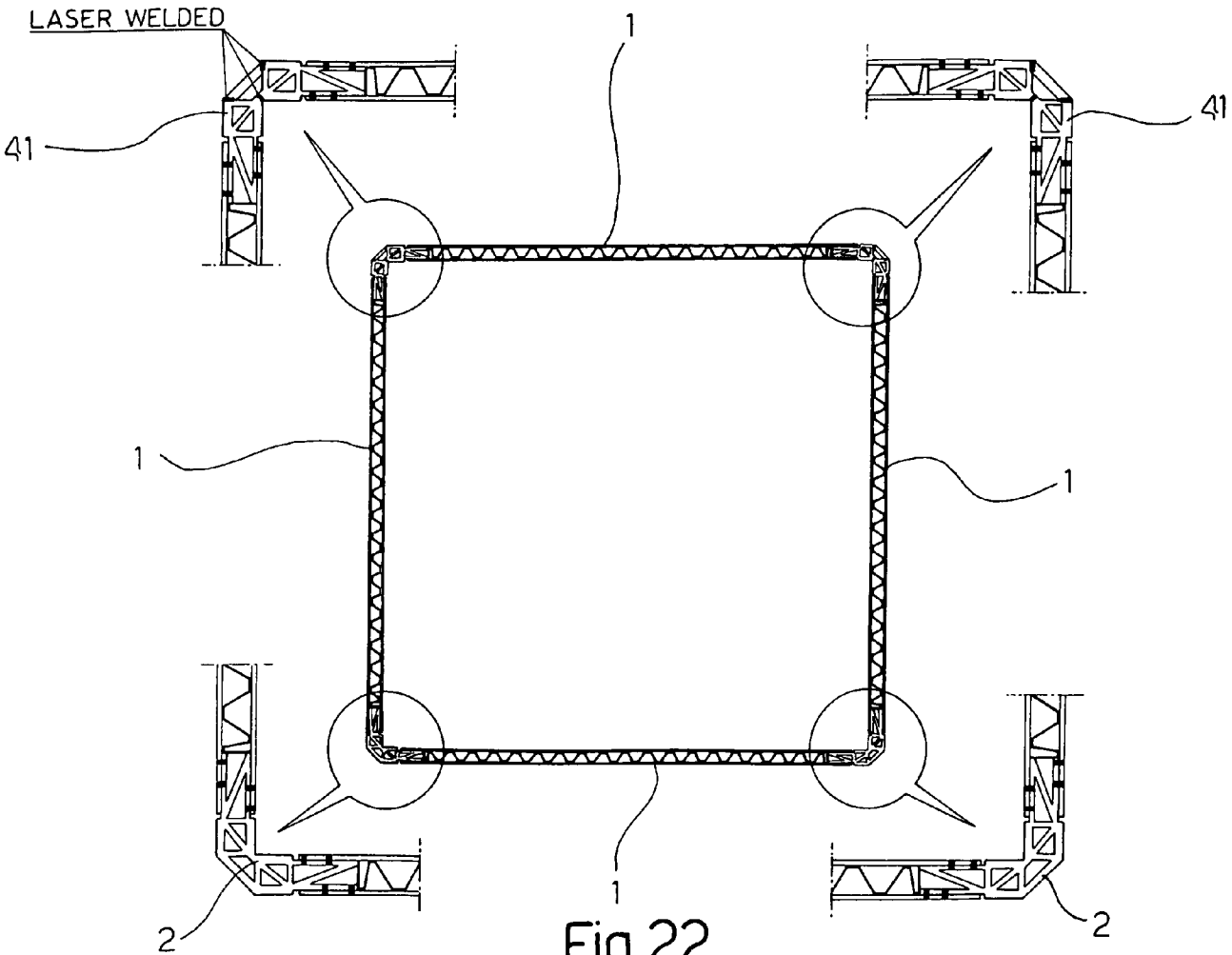
FIG. 22 is similar to FIG. 21, and shows the FIG. 21 components in a different operating position.

FIGS. 18 to 25 show a preferred method of producing a typical parallelepiped-shaped square-section casing K. In the preferred embodiment, square-section casing K is formed using four longitudinal panels 1, two one-piece angle members 2, and two multiple-part angle members 41 (FIGS. 20, 21 and 22). The above eight parts are connected by laser welding or other, e.g. friction, welding methods.

Figure 23:
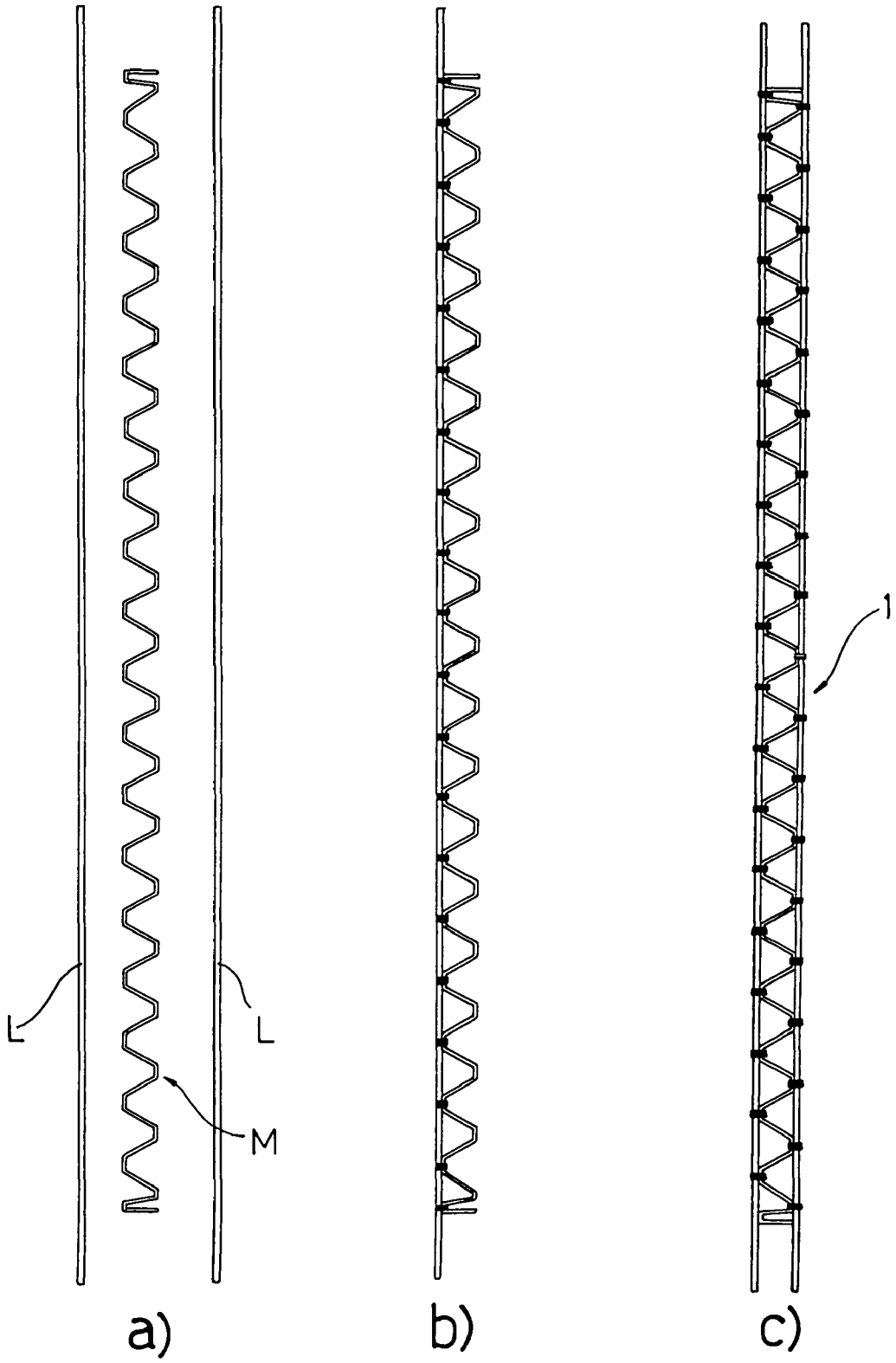
FIG. 23 shows stages in the assembly of the FIG. 18 detail.

FIG. 23 shows the steps in producing a longitudinal panel 1 using two outer metal sheets L, and an appropriately bent sheet metal core M (FIG. 23*a*). In the embodiment shown, core M has a variable-pitch fretted cross section. Alternatively, core M has a variable-pitch, trapezoidal, saw-tooth cross section. Both the outer sheets and core M are conveniently made from 0.5 to 1 millimeter thick sheets of aluminium alloy. All the joints are preferably formed by laser welded or other equivalent welding methods. In this particular case, laser welding enables the use of particularly thin sheet metal, while at the same time obtaining extremely strong but, above all, lightweight casings 28. The FIG. 18 enlargement shows the weld areas F between the two metal sheets L and core M. With reference to FIG. 23, to begin with, core M is positioned with its ribs parallel to the length of the panel, and is welded to one of metal sheets L (FIG. 23*b*); after which, the other metal sheet L is also welded to core M as shown in FIG. 23*c*. As a result, only some of the welds are visible on the outside of the panel. The welds may be seam or spot welds.

Angle members 2 are formed from an extruded section having the cross section shown in FIG. 19. With reference to FIG. 19, each angle member 2 has two longitudinal end portions 2*a*, each of which is smaller in section than the rest of the corresponding wall, and are sized to slide inside a longitudinal seat in a corresponding panel 1, as shown in FIGS. 21 and 22. Inside the seats, portions 2*a* are welded to corresponding panels 1.

Figure 25:
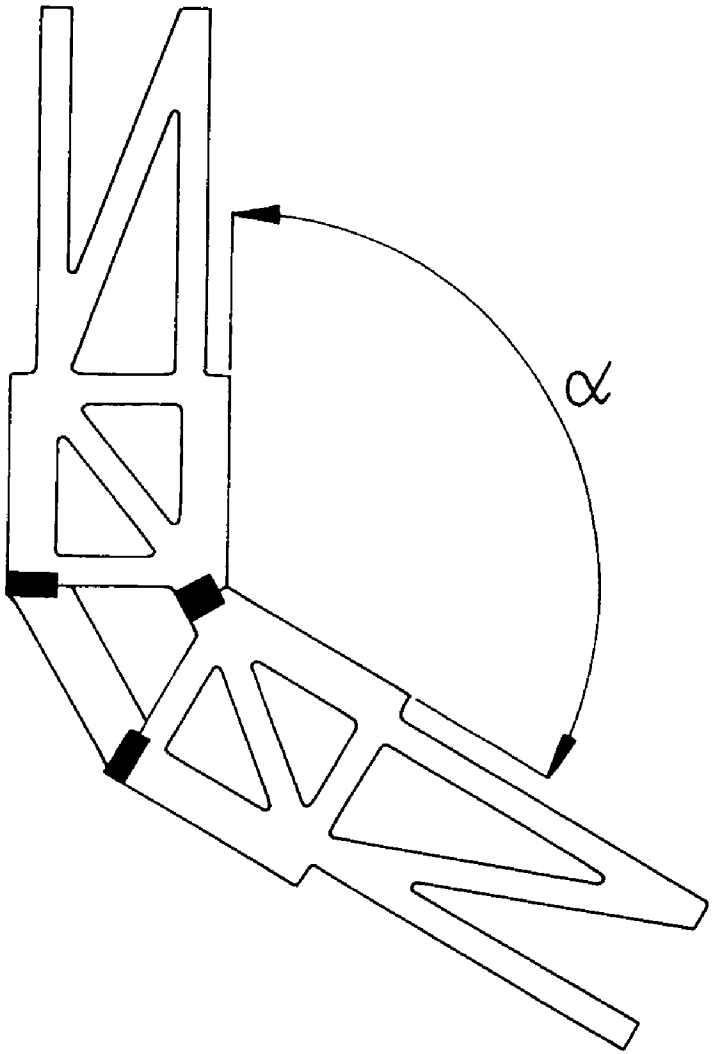
FIG. 25 shows a variation of the FIG. 20 detail.

As shown in FIG. 20, in the preferred embodiment, multiple-part angle members 41 comprise three parts: two lateral section parts, and a central, substantially plate-like part, which are connected by laser welding or other suitable welding methods, and are shaped to define a right-angle member 41 as shown in FIGS. 20-22, or an obtuse-angle (angle $\gamma$) member 41 as shown in FIG. 25. The size of angle $\gamma$ depends on the section of casing K being produced.

Figure 24:
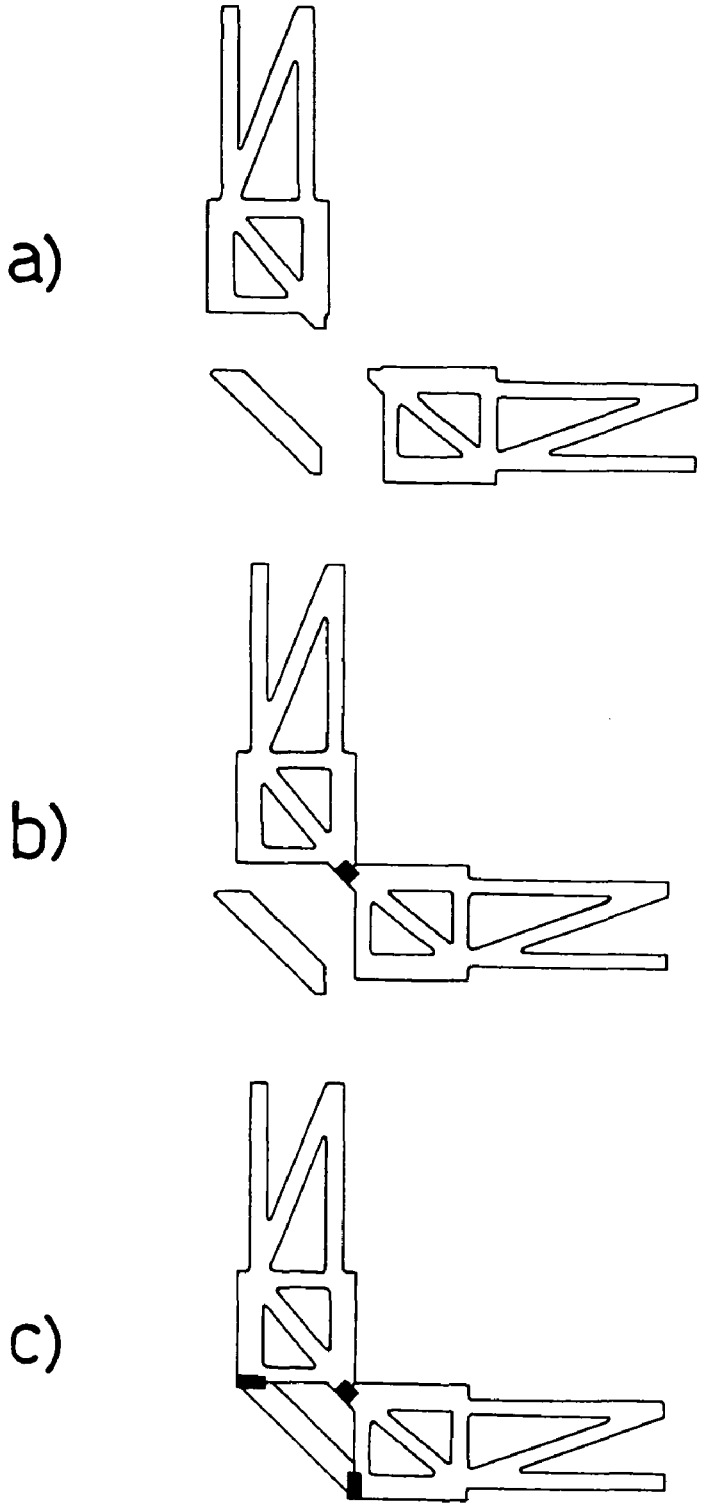
FIG. 24 shows stages in the assembly of the FIG. 20 detail.

Angle members 41 are formed in the steps shown in FIG. 24. More specifically, the three parts are first formed; the lateral parts are then welded to each other, by laser welding or other equivalent welding methods, along respective tangent inner edges; and, once the lateral parts are welded, the central part is positioned obliquely (FIG. 24*b*) and welded to both the lateral parts as shown in FIG. 24*c*.

Right-angle members 2, 41 are used to form square- or rectangular-section casings; and generic-angle members 2, 41 are used for generic, e.g. hexagonal, sections.

With reference to FIGS. 21 and 22, casings K are formed as follows. Firstly, longitudinal panels 1 and angle members 2, 41 are formed. Two pairs of panels 1 are then connected by respective angle members 2, as shown in FIGS. 21 and 22, to form two elongated L-shaped portions. The elongated L-shaped portions are then connected to each other by two multiple-part angle members 41 (FIG. 20) as shown in FIGS. 21 and 22. As also shown in FIGS. 21 and 22, multiple-part members 41 may be located along a diagonal of the cross section of the casing, as shown in FIG. 21, or along one side of the cross section, as shown in FIG. 22. In which case, three lateral panels 1 are connected to one another by two members 2 to form a body with a U-shaped cross section.

Each assembly 28 described is therefore a munition-configured-missile type, i.e. complete with a container for housing, transporting, and launching the missile housed inside.

The design characteristics of each assembly 28 in general, and of casing K in particular, therefore pose no limits as to the form and geometry of either assembly 28 or groups 20 or 38, so that a larger number of assemblies 28 can be accommodated in a given volume as compared with known solutions. The design characteristics of assemblies also make them much lighter, compact, and stronger than known solutions, which is mainly due to the fixed- or preferably variable-pitch truss design of the profiles used for the main structures.

What is more, assemblies 28 described are highly efficient, reliable, and easy to use, mainly on account of the jet deflector incorporated in or fitted to each missile housing-launch casing K. As stated, the missile engine exhaust gas deflector provides for directing the exhaust gas in a preferential direction, to prevent it affecting the sensitive parts of the launcher or anything adjacent to the launcher. Providing a jet deflector for each disposable housing-transportation-launch assembly 28 enables a considerable reduction in weight and size, and provides for greatly increasing reliability (by eliminating the need for actuating devices) and flexibility as compared with known solutions, and particularly as compared with conventional use of a large, heavy, mobile jet deflector integrated in the launcher structure and catering to all the missiles on the launcher.

The efficiency, reliability, and safety of assemblies 28 are further enhanced by the guide assembly inside casing K, and by the minimum- and maximum-thrust retaining devices. The guide assembly, in fact, clearly provides, on the one hand, for maintaining a given trajectory at the launch stage, and, on the other, for safeguarding against external shock and vibration both during transport and at the launch stage. Whereas the retaining devices safeguard against inadvertent launching, and are of straightforward design for light weight and compactness.

The ground launcher described can be set independently to the vertical launch position, and at the same time is highly mobile, easy to transport, and efficient (can be rolled on/off small aircraft, such as C-130s, and can be reloaded with no external equipment required).

As regards outer casings K, the manufacturing method described provides for achieving performance unobtainable by currently known equipment. The truss design cross section of lateral panels 1 of the casing, in fact, converts stress transmitted to the casing into substantially tensile or compressive stress, thus maximizing structural use of the materials. The variable pitch of the trusses depends on the variable bending moment to which the cross sections are subjected, and is so selected (taking into account local pressure-induced stress on the inner surface) that the material is uniformly stressed. This, together with laser or equivalent welding, provides for obtaining extremely thin structures, which cannot be obtained using conventional manufacturing methods (e.g. extrusion), but which are achievable using the aluminium alloy welding method.

Releasably connecting assemblies 28 in fixed, one-only relative positions provides for forming "multitube" assemblies, in which assemblies 28 are interchangeable, thus simplifying replacement at the launch site.

Finally, using a rear breakthrough wall together with a jet deflector solves the problems posed by an integrated compensation chamber, as described in U.S. Pat. No. 6,526,860.

The invention claimed is:

1. A housing-transportation-launch assembly (28) for a missile (21), the assembly comprising an outer casing (K) for directly housing said missile, the casing (K) being made of metal and comprising a lateral wall, a front breakthrough wall connected to said lateral wall, a jet deflector connected integrally to a rear portion of said lateral wall, and a rear breakthrough wall closing an outlet of said jet deflector and which is broken by the exhaust gases of said missile;

and further comprising guide means for guiding said missile and housed in said casing.

2. An assembly as claimed in claim 1, wherein said jet deflector comprises a deflecting surface for guiding an exhaust jet in an exhaust direction crosswise to a longitudinal axis of said casing, and directing the jet far away from said casing.

3. An assembly as claimed in claim 1, wherein said jet deflector conducts said exhaust jet along a curved exhaust path.

4. An assembly as claimed in claim 1, wherein said assembly is modular to fit positively and interchangeably to an identical modular missile housing-transportation-launch assembly.

5. An assembly as claimed in claim 1, further comprising releasable connecting means for connecting said casing to a casing of an adjacent housing-transportation-launch assembly.

6. An assembly as claimed in claim 5, wherein said assembly is directly connectable with one or two identical assemblies, placed on top or underneath, by said connecting means, which comprise locating means for positioning said assemblies in a fixed, one-only position; and releasable locking means for locking said casings one against another.

7. An assembly as claimed in claim 6, wherein said locating means comprise at least one pair of pins projecting from said casing; and at least one pair of seats, each engaged by a relative said pin.

8. An assembly as claimed in claim 7, wherein said pins each comprise a tapered end portion.

9. An assembly as claimed in claim 6, wherein said locating means and said releasable locking means comprise at least one pair of common pins projecting from said casing; each said common pin comprising a locating portion engaging a relative retaining seat on the casing of an adjacent assembly (28), and a retaining portion cooperating with an inclined-surface retaining body.

10. An assembly as claimed in claim 1, at least some of said guide means being fitted to said casing to slide in a direction parallel to an axis of said casing.

11. An assembly as claimed in claim 10, wherein said guide means comprise a front guide block and a rear guide block separate from each other.

12. An assembly as claimed in claim 11, wherein said front guide block and said rear guide block each comprise at least one pair of guides independent of each other.

13. An assembly as claimed in claim 12, wherein at least some of said guides are defined by lengths of ribbed tubular sections.

14. An assembly as claimed in claim 12, wherein said guides are made of polyurethane or other equivalent damping material performing like a shock and vibration absorber to protect the missile during transport and to reduce the forces transmitted by the missile to the casing during launching.

15. An assembly as claimed in claim 11, wherein said guide means comprise at least one block of polyurethane material.

16. An assembly as claimed in claim 1, further comprising a minimum-thrust retaining device, said minimum-thrust retaining device comprising a fastening member for attachment to a portion of the casing, and a break-off member connecting the fastening member to said missile.

17. An assembly as claimed in claim 1, further comprising a maximum-thrust retaining device, said maximum-thrust retaining device comprising a fastening member for attachment to said casing, a movable member for releasably connecting the fastening member to the missile, and an electric drive motor for moving said movable member between a retaining position and a release position.

18. An assembly as claimed in claim 1, wherein said lateral wall comprises a number of longitudinal lateral panels; at least one pair of first connecting members; and at least one pair of second connecting members differing constructionwise from said first connecting members.

19. An assembly as claimed in claim 18, wherein said first connecting members are one-piece bodies, and said second connecting members are bodies formed by welding a number of separate parts.

20. An assembly as claimed in claim 19, wherein each second connecting member comprises three parts, including two lateral section parts, and a central, substantially plate-like part.

21. An assembly as claimed in claim 18, wherein each of said longitudinal lateral panels comprises two flat lateral metal sheets, and an intermediate core defined by a corrugated metal sheet having corrugations parallel to the length of said longitudinal lateral panel; said core being seam- or spot-welded to both lateral sheets.

22. An assembly as claimed in claim 21, wherein said lateral sheets and said core are made of aluminum alloy, and are 0.5 to 1 millimeters thick.

23. An assembly as claimed in claim 21, wherein said core has a variable-pitch, fretted cross section.

24. An assembly as claimed in claim 21, wherein said core has a variable-pitch, trapezoidal saw-tooth cross section.

25. A ground launcher comprising a self-propelled structure; a supporting structure loaded with a number of housing-transportation-launch assemblies as claimed in claim 1, and fitted adjustably to said self-propelled structure; and actuating means for moving the supporting structure between a loading position and a launching position; said supporting structure comprising first locating and retaining means which engage second locating and retaining means on each of said housing-transportation-launch assemblies.

26. A launcher as claimed in claim 25, wherein said locating and retaining means comprise at least one pair of pins fitted integrally to said supporting structure and projecting from said supporting structure and at least partly into the housing-transportation-launch assembly positioned directly contacting the supporting structure.

27. A housing-transportation-launch assembly for a missile, the assembly comprising an outer casing (K) housing said missile, the casing (K) being made of metal and comprising a lateral wall, a front breakthrough wall, a jet deflector connected integrally to a rear portion of said lateral wall, and a rear breakthrough wall closing an outlet of said jet deflector and which is broken by the exhaust gases of said missile, and further comprising releasable connecting means for connecting said casing to a casing of an adjacent housing-transportation-launch assembly, wherein said assembly is directly connectable with one or two identical assemblies, placed on top or underneath, by said connecting means, which comprise locating means for positioning said assemblies in a fixed, one-only position; and releasable locking means for locking said casings one against another, and wherein said releasable locking means comprise means for blocking pins projecting from said casing; and inclined-surface retaining means cooperating with tie means for tightening or forcing the two casings against each other.

28. An assembly as claimed in claim 27, wherein said tie means comprise at least one pair of further pins; and said inclined-surface retaining means comprise, for each said further pin, a wedge-shaped body which cooperates with and rests against a portion of said further pin, and actuating means for moving said wedge-shaped bodies in a direction crosswise to said further pins.

29. An assembly as claimed in claim 28, wherein said actuating means comprise a cam device operated from outside the casing.

30. An assembly as claimed in claim 29, wherein said cam device comprises at least one movable cam; and, for each said wedge-shaped body, a sliding rod, which translates in a direction crosswise to the travel direction of said cam, and is connected to the relative said wedge-shaped body at one end, and to said cam at the other end.

31. An assembly as claimed in claim 30, wherein said cam is movable both ways in a longitudinal direction parallel to an axis of said casing.

32. An assembly as claimed in claim 31, wherein said cam is operated by lever means located outside said casing; tie/push means being interposed between said cam and said lever means.

33. An assembly as claimed in claim 30, wherein said cam is interposed between two said sliding rods to operate said sliding rods and the relative said wedge-shaped bodies simultaneously.

34. An assembly as claimed in claim 33, wherein said cam is V-shaped.

35. A method of producing a casing for housing, transporting, and launching missiles, the method comprising the steps of:

forming a number of longitudinal lateral panels;

forming at least one pair of first connecting members for connecting said lateral panels to one another, and at least one pair of second connecting members for connecting said lateral panels and differing constructionwise from said first connecting members; and stably connecting the lateral panels to one another by means of said first and second connecting members, connection of said lateral panels comprising the steps of forming at least two distinct portions, at least one of which comprises at least two lateral panels connected to each other by said first connecting members, and stably welding said portions to each other by means of said second connecting members, producing each of said lateral panels (1) comprising the steps of preparing two flat metal sheets; forming a corrugated body; placing said corrugated body between said metal sheets, so that the corrugations are parallel to the length of said lateral panel; and welding said metal sheets to said corrugated body, said corrugated body having a variable-pitch, fretted cross section.

36. A method as claimed in claim 35, wherein each of said portions is obtained by connecting two lateral panels to each other by means of a relative said first connecting member; said portions being connected to each other by a pair of said second connecting members located along a diagonal of the cross section of said casing.

37. A method as claimed in claim 36, wherein one of said portions has a U-shaped cross section, and is obtained by connecting three said lateral panels to one another by means of a pair of said first connecting members; said portions being connected to each other by two said second connecting members located on opposite sides of the other of said portions.

38. A method as claimed in claim 35, wherein said first connecting members are one-piece bodies, and said second connecting members are bodies formed by joining a number of separate parts.

39. A method as claimed in claim 38, wherein said separate parts are joined by welding.

40. A method as claimed in claim 35, wherein said metal sheets and said corrugated body are formed from sheet metal.

41. A method as claimed in claim 40, wherein said metal sheets are welded to said corrugated body so that the welds on one of said metal sheets are invisible from the outside.

42. A method as claimed in claim 35, wherein said metal sheets and said corrugated body are seam- or spot-welded to one another.

43. A method as claimed in claim 35, wherein said corrugated body has a variable-pitch, trapezoidal saw-tooth cross section.

* * * * *